US007603975B2

(12) United States Patent
Sugiura et al.

(10) Patent No.: US 7,603,975 B2
(45) Date of Patent: Oct. 20, 2009

(54) VALVE TIMING CONTROLLER

(75) Inventors: Taei Sugiura, Anjo (JP); Motoki Uehama, Kariya (JP); Akiyuki Sudou, Takahama (JP); Yasushi Morii, Nogoya (JP)

(73) Assignee: Denso Corporation, Kariya (JP)

( * ) Notice: Subject to any disclaimer, the term of this patent is extended or adjusted under 35 U.S.C. 154(b) by 312 days.

(21) Appl. No.: 11/645,621

(22) Filed: Dec. 27, 2006

(65) Prior Publication Data

US 2007/0163526 A1 Jul. 19, 2007

(30) Foreign Application Priority Data

Jan. 16, 2006 (JP) ..... 2006-007361
Jul. 14, 2006 (JP) ..... 2006-193774
Sep. 5, 2006 (JP) ..... 2006-240365

(51) Int. Cl.
*F01L 1/34* (2006.01)

(52) U.S. Cl. ..... 123/90.17; 123/90.15; 464/160; 475/331

(58) Field of Classification Search ..... 123/90.5, 123/90.16, 90.17, 90.18, 90.15; 464/1, 2, 464/160; 475/331
See application file for complete search history.

(56) References Cited

U.S. PATENT DOCUMENTS 6,637,389 B2 10/2003 Schafer et al.
7,377,242 B2 * 5/2008 Uehama et al. ..... 123/90.17

FOREIGN PATENT DOCUMENTS

JP 2002-061727 2/2002

* cited by examiner

*Primary Examiner*—Ching Chang
(74) *Attorney, Agent, or Firm*—Nixon & Vanderhye P.C.

(57) ABSTRACT

A valve timing controller includes a first gear rotating together with a crankshaft, a planetary carrier eccentric to the first gear, a second gear engaging with the planetary carrier. The second gear performs a planetary motion while engaging with the first gear. The planetary motion is converted into a rotational motion of the camshaft to change a relative rotational phase between the crankshaft and the camshaft. A pressing element is provided between the planetary carrier and the second gear for pressing the second gear by the elastic force. An action line of the elastic force is inclined to the eccentric direction line of the planetary carrier in the circumferential direction.

35 Claims, 31 Drawing Sheets

VALVE TIMING CONTROLLER

CROSS-REFERENCE TO RELATED APPLICATION

This application is based on Japanese Patent Applications No. 2006-7361 filed on Jan. 16, 2006, No. 2006-193774 filed Jul. 14, 2006, and No. 2006-240365 filed on Sep. 5, 2006, the disclosure of which are incorporated herein by reference.

FIELD OF THE INVENTION

The present invention relates to a valve timing controller for an internal combustion engine which adjusts valve timing of at least one of an intake valve and an exhaust valve opened/closed by a camshaft on the basis of torque transmission from a crankshaft to the camshaft.

BACKGROUND OF THE INVENTION

There is conventionally known a valve timing controller which forces a planetary gear engaging with an internal gear rotating together with a crankshaft to perform a planetary motion for converting the planetary motion of the planetary gear into a motion of a camshaft, thereby changing a relative rotation phase between the camshaft and the crankshaft (for example, U.S. Pat. No. 6,637,389B2). During operating of such a valve timing controller, changing torque is transmitted from the camshaft to the device by a drive reaction of a valve opened/closed by the camshaft. The planetary gear rattles to the internal gear due to this changing torque transmission to cause tooth hit between the planetary gear and the internal gear, thereby generating abnormal noises. For preventing occurrence of abnormal noises due to the tooth hit, it is considered that the planetary gear is pressed in the eccentric direction by an elastic force of a pressing member to the internal gear, thus restricting the rattle of the planetary gear to the internal gear (refer to JP-2002-61727A).

According to the above method of pressing the planetary gear, however, the pressing direction is in conformity to the eccentric direction of the planetary gear and therefore, the planetary gear is supported only at two locations, i.e., an operational location of the pressing force on the eccentric direction line and an engagement location with the internal gear. As a result, in a case where an outside force acting on the planetary gear due to the torque transmission from the camshaft deviates from the eccentric direction of the planetary gear, it is impossible to restrict the rattle of the planetary gear, resulting in generation of abnormal noises.

SUMMARY OF THE INVENTION

The present invention has been made in view of the foregoing problems and an object of the present invention is to provide a valve timing controller which restricts abnormal noises.

According to an aspect of the present invention, a valve timing controller includes a first gear element rotating in association with a first shaft which is one of a crankshaft and a camshaft, a planetary carrier including an outer peripheral surface eccentric to the first gear element, a second gear element including a central bore rotatably engaging with the outer peripheral surface and performing a planetary motion while engaging with the first gear element, a conversion portion for converting a relative rotational phase between the crankshaft and the camshaft, and a pressing element provided between the planetary carrier and the central bore. The second gear element forms a gear mechanism in an internal tooth engagement with the first gear element for performing a planetary motion, therefore unavoidably producing a clearance in the engagement boundary face between the first and second gear elements due to a manufacturing tolerance or the like. The pressing element presses an inner peripheral surface of the central bore by an elastic force thereof. A line of action of such an elastic force (hereinafter referred to as "elastic force action line") is inclined in the circumferential direction of the outer peripheral surface of the planetary carrier with respect to the eccentric direction line of the outer peripheral surface thereof. Therefore, the second gear element subject to the elastic force from the pressing element rotates around an engagement location with the first gear element by an amount equal to the clearance between the planetary carrier and the central bore. The second gear element contacts the outer peripheral surface of the planetary carrier at a location different from an intersection engagement between the inner peripheral surface of the central bore and the elastic force action line. Thereby, the second gear element is to be supported by at least three points, i.e., the intersection location between the inner peripheral surface of the central bore and the elastic force action line, the contact location between the inner peripheral surface of the central bore and the outer peripheral surface of the planetary carrier and the engagement location between the first and second gear elements.

According to the above support arrangement of the second gear element, even if the changing torque is transmitted from the second, which is the other of the camshaft and the crankshaft, through the conversion portion to the second gear shaft, it is difficult for the second gear element to rattle to the first gear element. As a result, the tooth hit between the first and second gear elements due to the changing torque is avoided, thus preventing generation of abnormal noises.

BRIEF DESCRIPTION OF THE DRAWINGS

Other objects, features, and advantages of the present invention will become more apparent from the following detailed description made with reference to the accompanying drawings, in which like portions are designated by like reference numbers and in which.

DETAILED DESCRIPTION OF EXAMPLE EMBODIMENT

A plurality of embodiments of the present invention will be hereinafter explained with reference to accompanying drawings. Components identical to those in each embodiment are referred to as identical numerals and the same explanation is omitted.

First Embodiment

Figure 2:
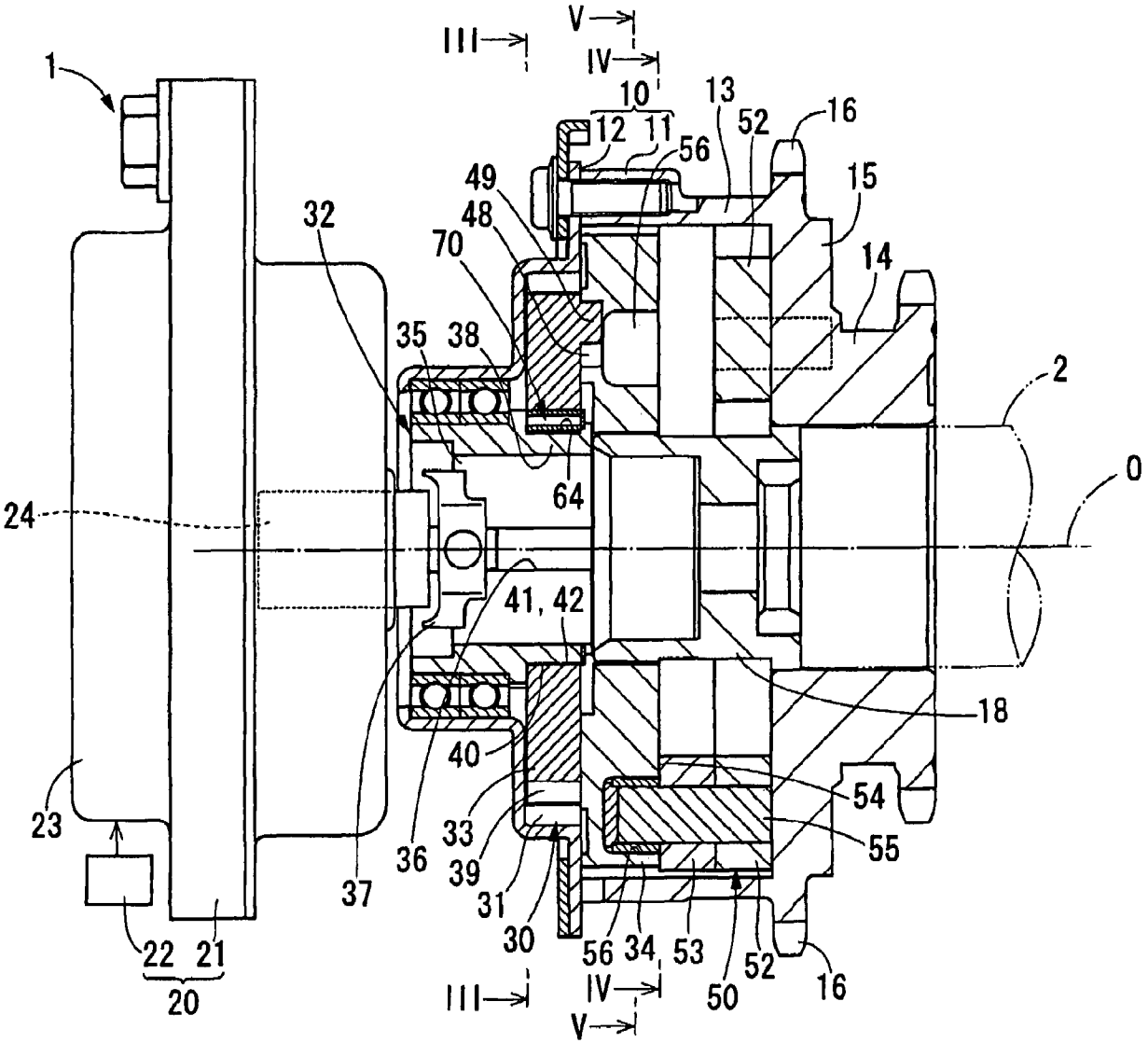
FIG. 2 is a cross section taken on line II-II in FIG. 4, showing a valve timing controller in a first embodiment of the present invention.

FIG. 2 shows a valve timing controller 1 in a first embodiment of the present invention. The valve timing controller 1 is provided in a transmission system for transmitting an engine torque from a crankshaft to a camshaft 2 for an internal combustion engine. The valve timing controller 1 changes a relative rotational phase of the camshaft to the crankshaft (hereinafter referred to as "engine shaft phase") to adjust valve timing of an intake valve for the engine.

The valve timing controller 1 is provided with a drive-side rotational element 10, a driven-side rotational element 18, a control unit 20, a differential gear mechanism 30 and a link mechanism 50.

The drive-side rotational element 10 is formed in a hollow shape as a whole and receives the differential gear mechanism 30, the link mechanism 50 and the like therein. The drive-side rotational element 10 includes a two-shoulder cylindrical sprocket 11 and a two-shoulder cylindrical cover gear 12, a large diameter-side end portion of the sprocket 11 being threaded coaxially into a large diameter-side end portion of the cover gear 12. In the sprocket 11, a plurality of teeth 16 are formed in a connecting portion 15 connecting a large diameter portion 13 and a small diameter portion 14 in such a manner as to extend in the outer peripheral side. A circular timing chain is wound around the teeth 16 and a plurality of teeth of the crankshaft. Therefore, when the engine torque outputted from the crankshaft is transmitted through the timing chain to the sprocket 11, the drive-side rotational element 10 rotates around a rotational central line O together with rotation of the crankshaft while maintaining the relative rotational phase to the crankshaft. At this point, a rotational direction of the drive-side rotational element 10 is equal to a clockwise direction in FIG. 3.

Figure 4:
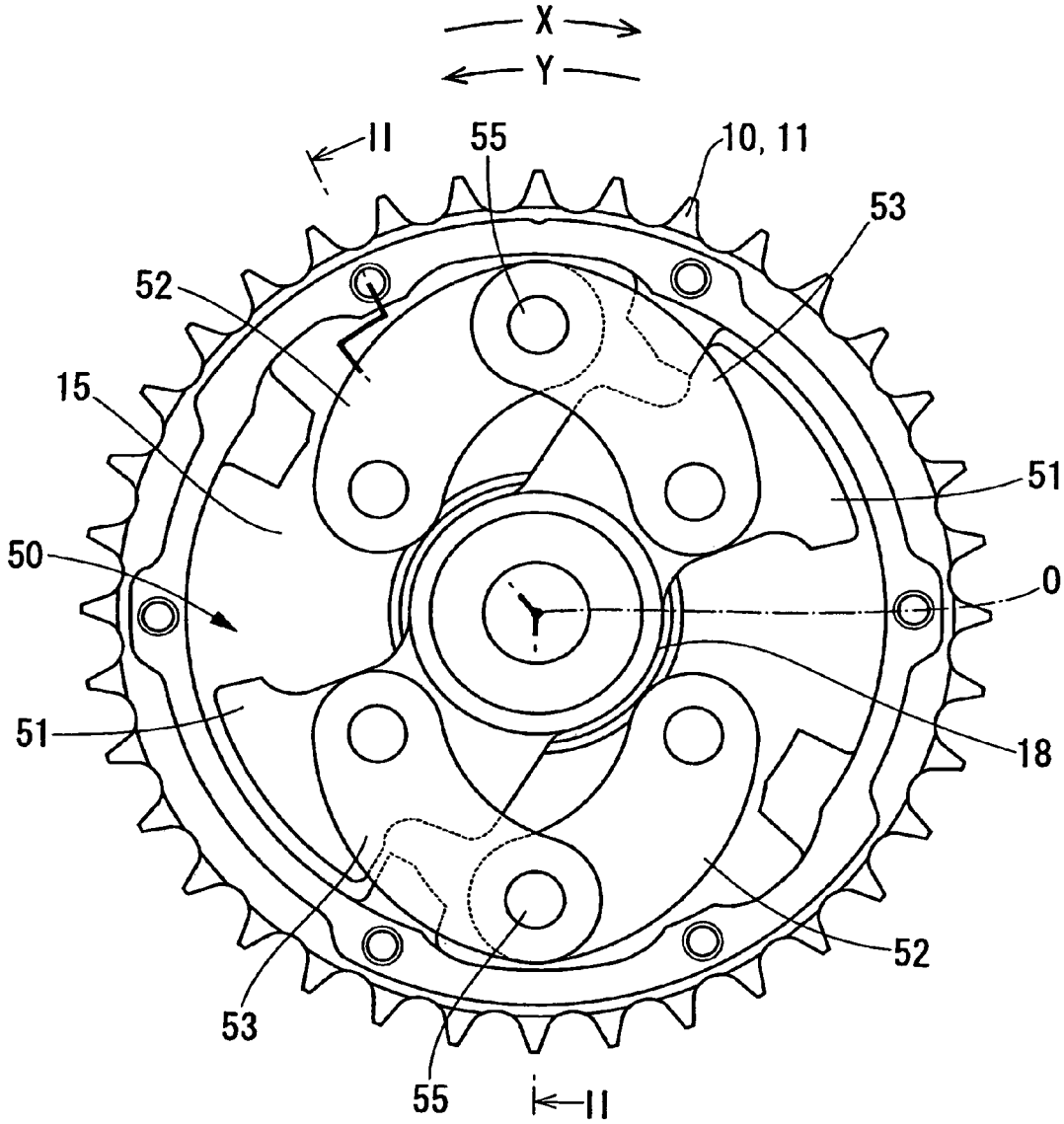
FIG. 4 is a cross section taken on line IV-IV in FIG. 2.

As shown in FIG. 2, the driven-side rotational element 18 is formed in a cylindrical shape and arranged coaxially with the drive-side rotational element 10 and the camshaft 2. One end of the driven-side rotational element 18 is slidably and rotatably engaged with an inner peripheral side of the connecting portion 15 of the sprocket 11 and also fixed to one end of the camshaft 2 by a bolt. Thereby, the driven-side rotational element 18 rotates around a rotational central line O together with rotation of the camshaft 2 while maintaining the relative rotational phase to the camshaft 2, and rotates relatively to the drive-side rotational element 10. As shown in FIG. 4, the relative rotational direction to which the driven-side rotational element 18 advances with respect to the drive-side rotational element 10 is an advance direction X and the relative rotational direction to which the driven-side rotational element 18 retards with respect to the drive-side rotational element 10 is a retard direction Y.

As shown in FIG. 2, the control unit 20 is composed of a combination of an electric motor 21, a power supply control circuit 22 and the like. The electric motor 21 is, for example, a brushless motor and includes a motor case 23 fixed through a stay (not shown) to the engine and a motor shaft 24 supported rotatably/counter-rotatably by the motor case 23. The power supply control circuit 22 is an electrical circuit such as a microcomputer and disposed outside or inside the motor case 23 to be electrically connected to the electric motor 21. The power supply control circuit 22 controls the power supply to a coil (not shown) of the electric motor 21 in response to an operating condition of the engine. This power supply control causes the electric motor 21 to form a rotational magnetic field around the motor shaft 24 and generates a rotational torque in the X and Y directions (refer to FIG. 3) in accordance with the directions of the rotational magnetic field in the motor shaft 24.

Figure 3:
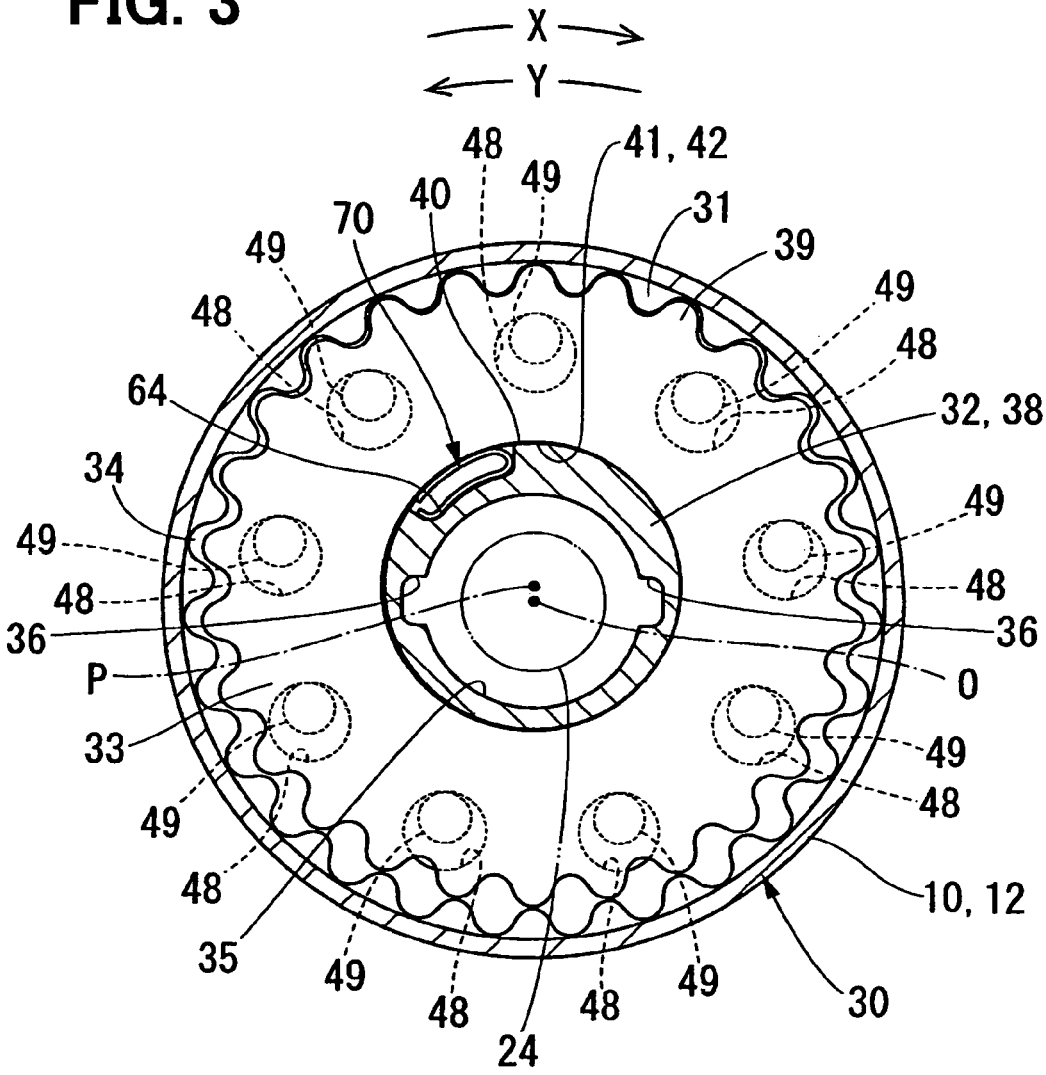
FIG. 3 is a cross section taken on line III-III in FIG. 2.

As shown in FIGS. 2 and 3, the differential gear mechanism 30 is composed of a combination of an internal gear portion 31, a planetary carrier 32, a planetary gear 33, a transmission rotational element 34 and the like.

The internal gear portion 31 of which a tip circle is located in an inner peripheral side of a root circle thereof is formed of an inner peripheral portion of the cover gear 12, and serves as a part of the drive-side rotational element 10. Therefore, when the engine torque is transmitted to the sprocket 11, the cover gear 12 rotates around a rotational central line O together with rotation of the crankshaft while maintaining the relative rotational phase to the crankshaft.

The planetary carrier 32 is formed in a cylindrical shape as a whole and includes an inner peripheral surface 35 formed in a cylindrical shape coaxially with the drive-side rotational element 10. A groove portion 36 is opened to the inner peripheral surface 35 of the planetary carrier 32 and the motor shaft 24 is fixed to the planetary carrier 32 coaxially with the inner peripheral surface 35 by a coupling 37 coupled to the groove portion 36. This fixation allows the planetary carrier 32 to rotate around a rotational central line O together with rotation of the motor shaft 24 and rotate relatively to the drive-side rotational element 10.

An eccentric cam portion 38 in the planetary carrier 32 provided at a side opposed to the motor shaft 24 includes a cylindrical, outer peripheral surface 40 eccentric to the drive-side rotational element 10.

Figure 1:
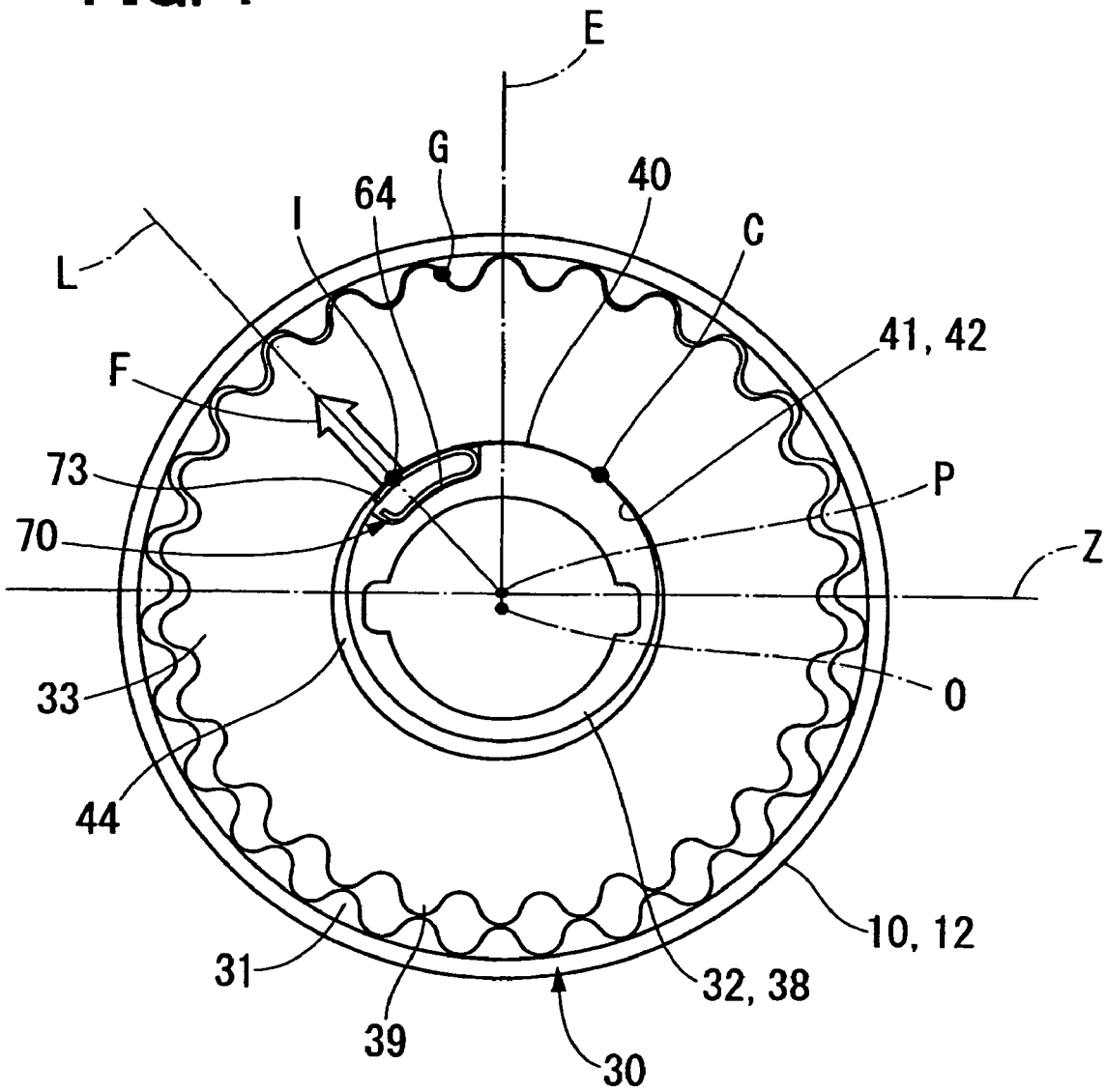
FIG. 1 is a diagram for explaining the feature of a valve timing controller in a first embodiment of the present invention.

The planetary gear 33 is formed in a circular plate shape and includes an external gear portion 39 of which a tip circle is arranged in an outer peripheral side of a root circle. In the planetary gear 33, the tip circle of the external gear portion 39 is smaller than the root circle of the internal gear portion 31 and the tooth number of the external gear portion 39 is by one less than that of the internal gear portion 31. The planetary gear 33 is eccentric to the rotational central line O and located in an inner peripheral side of the internal gear portion 31 and the external gear portion 39 engages with the internal gear portion 31 in the eccentric side of the planetary gear 33. That is, the planetary gear 33 and the cover gear 12 constitute the differential gear mechanism 30 with the internal gear engagement structure. A central bore 41 of the planetary gear 33 is formed in a cylindrical bore shape coaxially with the external gear portion 39, and an inner peripheral surface 42 of the central bore 41 slidably and rotatably engages with the outer peripheral surface 40 of the eccentric cam portion 38. Therefore, a clearance 44 due to a manufacturing tolerance or the like is, as emphatically shown in FIG. 1, formed in the engagement boundary face between the inner peripheral surface 42 of the central bore 41 and the outer peripheral surface 40 of the eccentric cam portion 38. According to the above arrangement, the planetary gear 33 realizes a planetary motion in such a manner that it self-rotates around the eccentric central line P of the outer peripheral surface 40 eccentric to the rotational central line O while performing an orbital motion in the rotational direction of the eccentric cam portion 38.

Figure 5:
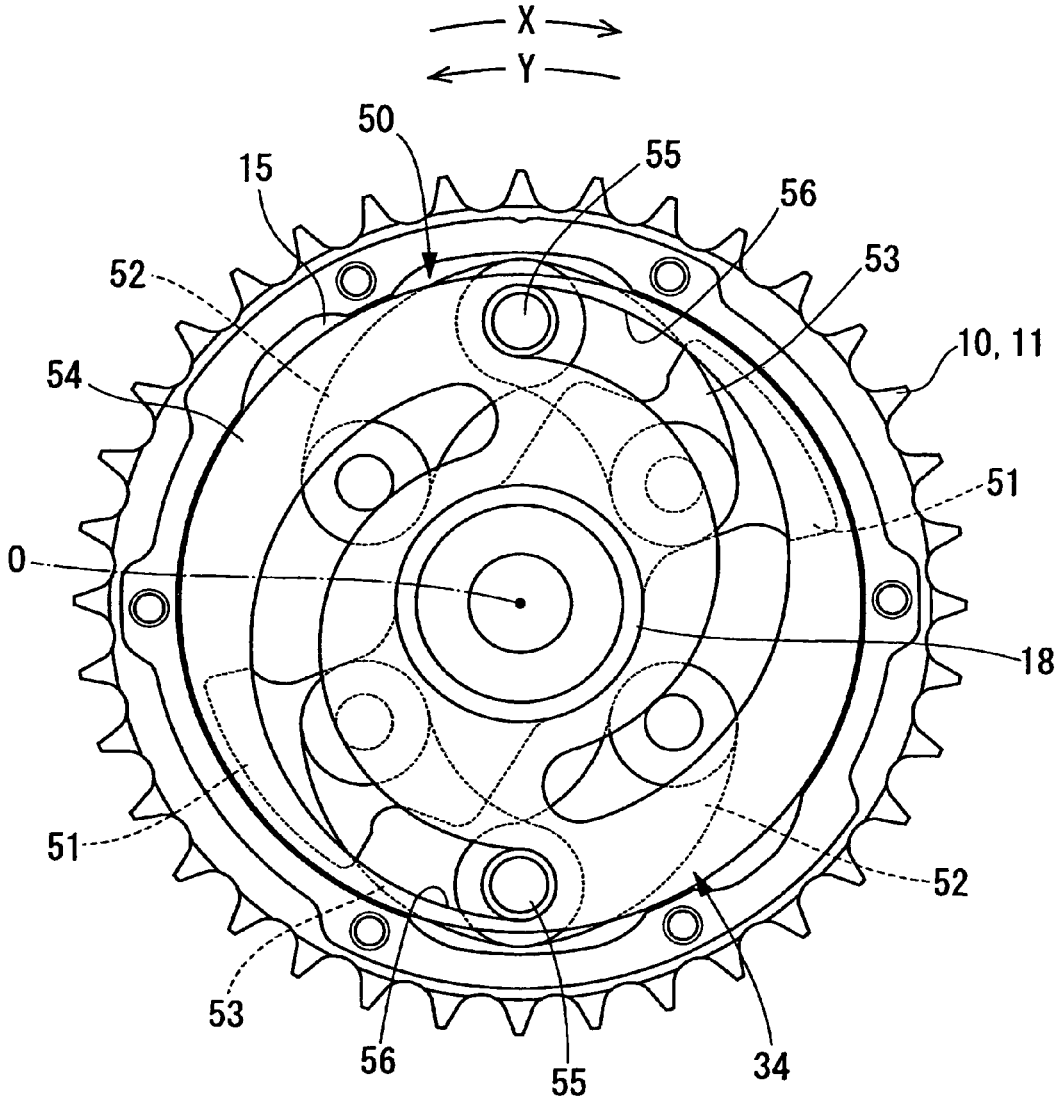
FIG. 5 is a cross section taken on line V-V in FIG. 2.

As shown in FIGS. 2 and 5, the transmission rotational element 34 is formed in a circular plate shape coaxially with the drive-side rotational element 10 and slidably and rotatably engages with the driven-side rotational element 18 at an outer peripheral side of an end opposed to the camshaft 2. This allows the transmission rotational element 34 to rotate around the rotational central line O and rotate relatively to the rotational elements 10 and 18. As shown in FIGS. 2 and 3, cylindrical-bore shaped engagement bores 48 are formed at a plurality of locations (here, nine locations) spaced by equal intervals in the circumferential direction of the transmission rotational element 34. In response to it, a columnar engagement projections 49 are formed at a plurality of locations (here, nine locations) spaced by equal intervals in the circumferential direction of the planetary gear 33, where the projections 49 enter into the corresponding engagement bores 48 for engagement.

In the differential gear mechanism 30 with this structure, when the planetary carrier 32 does not rotate relatively with the drive-side rotational element 10, the planetary gear 33 rotates with the drive-side rotational element 10 without the planetary motion and the engagement projection 49 presses the engagement bore 48 in the rotational side. As a result, the transmission rotational element 34 rotates in the clockwise direction in FIG. 5 while maintaining the relative rotational phase to the drive-side rotational element 10.

When the planetary carrier 32 rotates relatively in the retard direction Y to the drive-side rotational element 10 due to an increasing rotational torque of the motor shaft 24 in the direction Y or the like, the planetary gear 33 performs a planetary motion while changing an engagement tooth thereof with the internal gear portion 31 in the circumferential direction. Thereby, a force with which the engagement projection 49 presses the engagement bore 48 in the rotational side increases. As a result, the transmission rotational element 34 rotates relatively in the advance direction X to the drive-side rotational element 10. On the other hand, when the planetary carrier 32 rotates relatively in the advance direction X to the drive-side rotational element 10 due to an increasing rotational torque of the motor shaft 24 in the direction X or the like, the planetary gear 33 performs a planetary motion while changing an engagement tooth thereof with the internal gear portion 31 in the circumferential direction. Thereby, a force with which the engagement projection 49 presses the engagement bore 48 in the counter-rotational side increases. As a result, the transmission rotational element 34 rotates relatively in the retard direction Y to the drive-side rotational element 10. Thus, the differential gear mechanism 30 generates the planetary motion of the planetary gear 33 due to the relative rotational motion of the planetary carrier 32 to the drive-side rotational element 10 to convert the planetary motion into the relative rotational motion of the transmission rotational element 34 to the drive-side rotational element 10.

As shown in FIGS. 2, 4 and 5, the link mechanism 50 is composed of a combination of the links 51 to 53, a guide rotational portion 54, a movable shaft element 55 and the like. In FIGS. 4 and 5, a hatching showing a cross section is omitted.

A pair of first links 51 project in opposing directions from two locations placing a rotational central line O of the driven-side rotational element 18 therebetween. A pair of second links 52 are linked to the connecting portion 15 of the drive-side rotational element 10 by a turning pair at two locations placing the rotational central line O therebetween. A pair of third links 53 are linked by a turning pair to the corresponding first and second links 51 and 52 through the movable shaft element 55.

The guide rotational portion 54 is formed of a portion including an end face opposed to the planetary gear 33 in the transmission rotational element 34. A pair of guide passages 56 are formed at two locations placing the rotational central line O of the guide rotational portion 54 therebetween. Each guide passage 56 extends at an outer peripheral side of the rotational central line O and is formed in a curve shape where a distance from the rotational central line O to the guide passage 56 changes in the extending direction. Each guide passage 56 is provided in a rotational symmetry with each other around the rotational central line O and in particularly each guide passage 56 in the first embodiment is formed in a curve shape, which distances itself from the rotational central line O as it goes toward the direction Y.

A pair of movable shaft elements 55 are columnar and arranged at both sides placing the rotational central line O therebetween. One end of each movable shaft element 55 is slidably inserted into the corresponding guide passage 56. The other end of the movable shaft element 55 is relatively rotatably engaged with the corresponding second link 52. Further, an intermediate portion of each movable shaft element 55 is press-fitted into the corresponding third link 53.

When the transmission rotational element 34 maintains a relative rotational phase with the drive-side rotational element 10 in the link mechanism 50 with the above structure, the movable shaft element 55 does not slide in the guide passage 56 and rotates with the transmission rotational element 34. At this point, since a relative position relation between the pair elements of the second and third links 52 and 53 forming the turning pair and the rotational central line O does not change, the first link 51 and the driven-side rotational element 18 rotate in the clockwise direction in FIGS. 4 and 5 while maintaining the relative rotational phase to the drive-side rotational element 10, thus maintaining the engine shaft phase.

When the transmission rotational element 34 rotates relatively in the advance direction X to the drive-side rotational element 10, the movable shaft element 55 slides in the guide passage 56 to a side where it distances itself from the rotational central line O. Since the pair elements of the second and third links 52 and 53 forming the turning pair by this distance themselves from the rotational central line O, the first link 51 and the driven-side rotational element 18 rotate relatively in the retard direction Y to the drive-side rotational element 10 to retard the engine shaft phase. On the other hand, when the transmission rotational element 34 rotates relatively in the retard direction Y to the drive-side rotational element 10, the movable shaft element 55 slides in the guide passage 56 to a side where it approaches the rotational central line O. Since the pair elements of the second and third links 52 and 53 forming the turning pair by this approach the rotational central line O, the first link 51 and the driven-side rotational element 18 rotate relatively in the advance direction X to the drive-side rotational element 10 to advance the engine shaft phase. Thus in the link mechanism 50, the relative rotational motion of the transmission rotational element 34 to the drive-side rotational element 10 is converted into the relative rotational motion of the driven-side rotational element 18 to the drive-side rotational element 10, thereby changing the engine shaft phase.

Next, a feature part of the valve timing controller 1 in the first embodiment will be described in more detail.

Figure 6A:
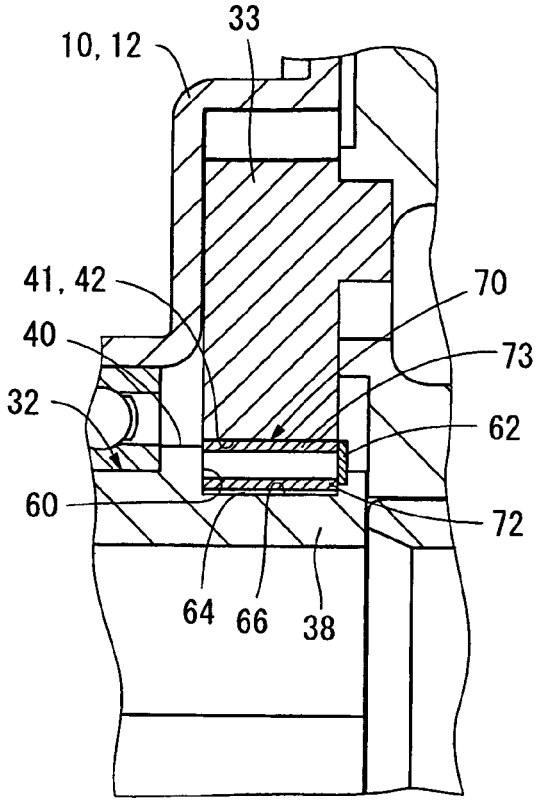
FIGS. 6A and 6B are enlarged cross sections showing a key part in FIGS. 2 and 3.
Figure 6B:
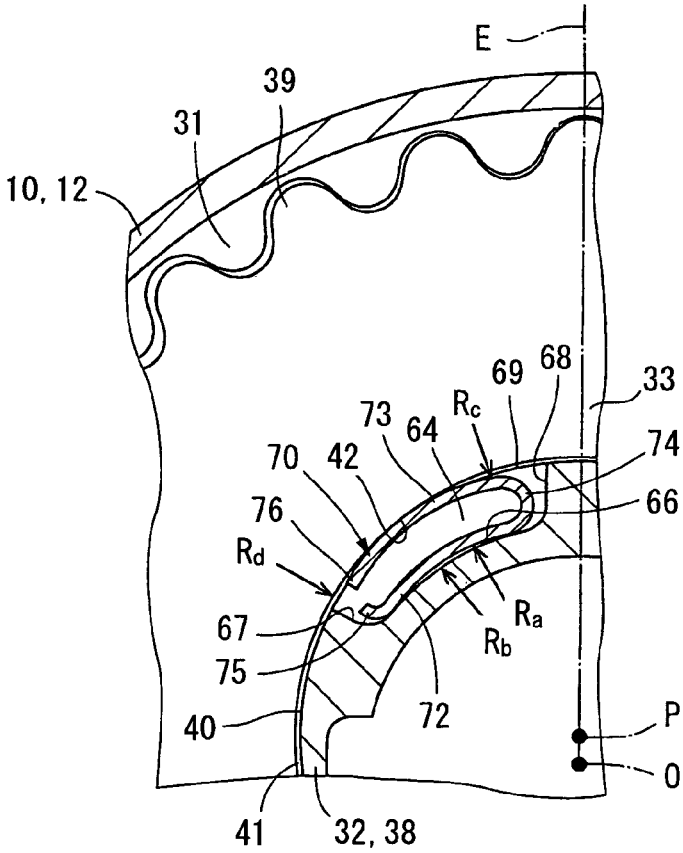
Figure 7:
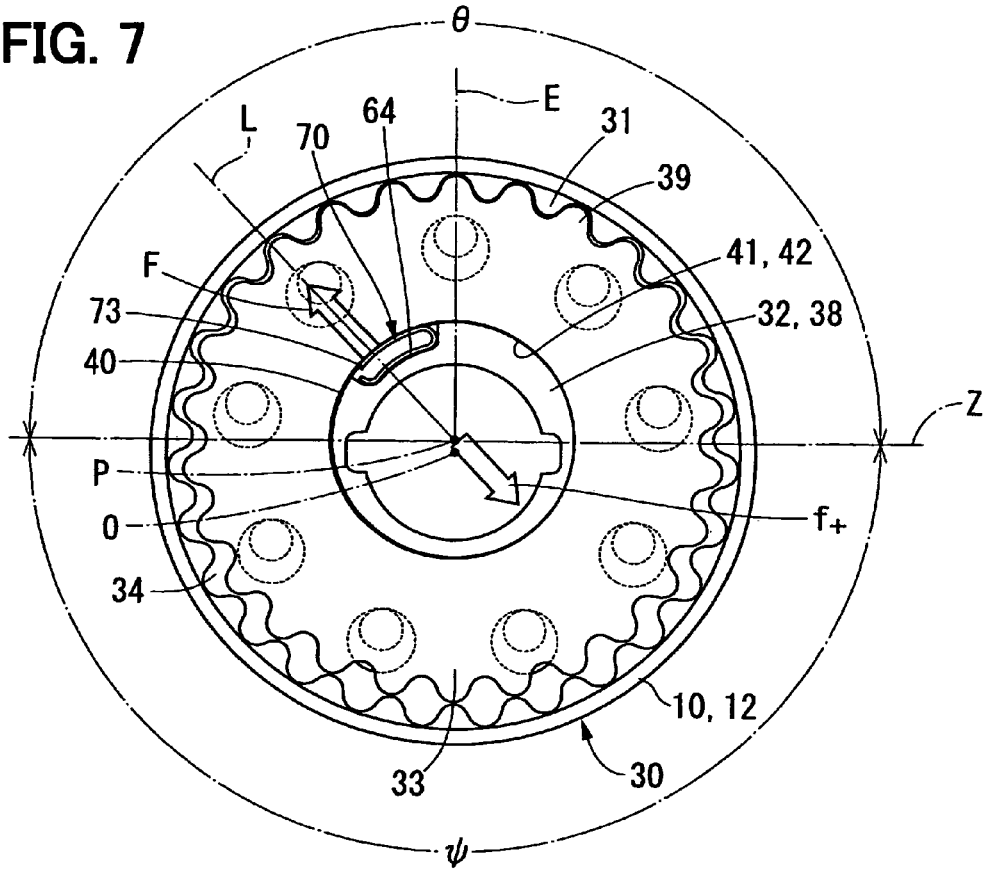
FIG. 7 is a diagram for explaining the feature of a valve timing controller shown in FIG. 2.

As shown in FIGS. 6A and 6B, a concave portion 60 opened to an outer peripheral side and one end side in the axial direction is formed in the eccentric cam portion 38 of the planetary carrier 32. Further, a C-letter shaped snap ring 62 is engaged and secured to the eccentric cam portion 38 and a receiving portion 64 surrounded by one end face of the snap ring 62 and an inner surface of the concave portion 60 is formed in the eccentric cam portion 38. As shown in FIG. 7, the receiving portion 64 is provided deviating from the eccentric direction line E to the circumferential direction (hereinafter referred to as "reference circumferential direction") of an outer peripheral surface 40 (hereinafter referred to as "eccentric outer peripheral surface") of the eccentric cam portion 38 within an angle region θ defined on the basis of the eccentric direction line E representing the eccentric direction of the eccentric outer peripheral surface 40. Here, "angle region θ" shows a region which is positioned in the eccentric side of the eccentric outer peripheral surface 40 from an orthogonal line Z orthogonal to the eccentric direction line E on the eccentric central line P of the eccentric outer peripheral surface 40.

As shown in FIGS. 6A and 6B, a spring member 70 is received in the receiving portion 64 in a state where the spring member 70 is retained between the snap ring 62 and the concave portion 60, so that it is arranged between the eccentric cam portion 38 and a central bore 41 of the planetary gear 33. The spring member 70 is a plate spring made of a metal sheet or the like bent in a substantially U-letter shape and includes an inner-peripheral-side contact portion 72, an outer-peripheral-side contact portion 73 and a connecting portion 74.

The inner-peripheral-side contact portion 72 has a circular cross section bent along a cylindrical, inner bottom surface of the receiving portion 64 and contacts the inner bottom surface 66. Here, a curvature radius Ra of the inner-peripheral-side contact portion 72 is set to be smaller than a curvature radius Rb of the inner bottom surface 66 of the receiving portion 64, whereby the inner-peripheral-side contact portion 72 is in contact with the inner bottom surface 66 at two locations in the reference circumferential direction. An end portion of both end portions in the reference circumferential direction of the inner-peripheral-side contact portion 72, which is more remote from the eccentric direction line E, forms a bending portion 75 bent in the outer peripheral side of the eccentric cam portion 38. This bending portion 75 is arranged as opposed to and spaced from an inner side face 67 of the inner side faces 67 and 68 in the receiving portion 64 which face with each other and place the spring member 70 in the reference circumferential direction therebetween.

The outer-peripheral-side contact portion 73 is disposed at the outer peripheral side of the inner-peripheral-side contact portion 72 and is spaced therefrom. The outer-peripheral-side contact portion 73 has a circular cross section bent along an inner peripheral surface of the central bore 41 in the planetary gear 33 (hereinafter referred to as "gear inner peripheral surface") and extends from an opening 69 of the receiving portion 64 through the eccentric outer peripheral surface 40 to contact the gear inner peripheral surface 42. Here, a curvature radius Rc of the outer-peripheral-side contact portion 73 is set to be smaller than a curvature radius Rd of the gear inner peripheral surface 42, whereby the outer-peripheral-side contact portion 73 is in contact with the gear inner peripheral surface 42 at one location in the reference circumferential direction. An end portion of both end portions in the reference circumferential direction of the outer-peripheral-side contact portion 73, which is more remote from the eccentric direction line E, forms a free end portion 76 cut completely from the bending portion 75 of the inner-peripheral-side contact portion 72. In other words, the end portions of the respective contact portions 72 and 73, which are remote from the eccentric central direction line E, are not connected, but arranged to be opened.

The connecting portion 74 connects both end portions in the reference circumferential direction of the contact portions 72 and 73, which are closer to the eccentric direction line E and is bent toward the eccentric direction line E in the reference circumferential direction. The connecting portion 74 is arranged as opposed to and spaced from an inner side face 68 of the inner side faces 67 and 68.

The spring member 70 with the above structure is compressed between the inner bottom surface 66 of the receiving portion 64 and the gear inner peripheral surface 42 to flexibly deform the connecting portion 74, thereby generating an elastic force F. The spring member 70 applies the generated elastic force F to a contact location with the outer-peripheral-side contact portion 73 of the gear inner peripheral surface 42 as shown diagrammatically in FIG. 7, thereby pressing the gear inner peripheral surface 42. At this point, the action line L of the elastic force F is inclined in the reference circumferential direction at a predetermined angle within the angle region θ to the eccentric direction line E, for example, approximately 45° and intersects with the gear inner peripheral surface 42 within the angle region θ.

Figure 8:
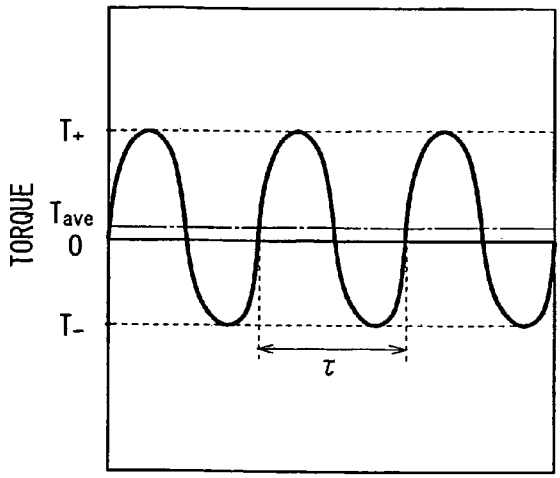
FIG. 8 is a characteristic graph for explaining changing torque.

According to the valve timing controller 1 in the first embodiment, the changing torque due to the drive reaction of the intake valve is transmitted from the camshaft 2 to the driven-side rotational element 18. This changing torque, as shown in FIG. 8, changes in each rotational cycle α of the engine between a positive torque in the direction for retarding the engine shaft phase and a negative torque in the direction for advancing the engine shaft phase. Here, the maximum positive torque $T_+$ is larger than the maximum negative torque T and therefore, an average value $T_{ave}$ of the changing torque is slant to a positive torque side.

Such changing torque is transmitted from the driven-side rotational element 18 through the link mechanism 50 and the transmission rotational element 34 to the planetary gear 33. As a result, the planetary gear 33 is to be subject to an outside force f in the direction in response to the changing torque to perform a planetary motion within the extent of no influence to the engine shaft phase. At this point, the direction of the outside force f which the planetary gear 33 is subject to is to change within the angle region α shown in FIG. 7, i.e., within the angle region ψ opposed to the angle region θ of the eccentric direction line E on the basis of the orthogonal line Z orthogonal to the eccentric direction line E. Therefore, according to the elastic force F the action line of which is inclined to the eccentric direction line E in the angle region θ, the outside force f can be cancelled out by the component in the opposing direction of the outside force f changing in direction within the angle region ψ. Further, in the first embodiment, when the changing torque becomes the maximum positive torque $T_+$ as shown in FIG. 7, the spring member 70 is arranged in such a manner that the direction of the elastic force F becomes opposed to that of the outside force $f_+$, thereby sufficiently canceling out the outside force $f_+$.

When the planetary gear 33 is subject to the elastic force the action line of which is inclined to the eccentric direction line E, the planetary gear 33 rotates by the clearance amount between the gear inner peripheral surface 42 and the eccentric outer peripheral surface 40 on the basis of the location G where the external gear portion 39 and the internal gear portion 31 are engaged. Therefore, the gear inner peripheral surface 42 contacts the eccentric outer peripheral surface 40 at a location C different from an intersection location I with the action line L. Accordingly, the planetary gear 33 is supported at three locations, i.e., the intersection location I between the gear inner peripheral surface 42 and the action line L, the contact location C between the gear inner peripheral surface 42 and the eccentric outer peripheral surface 40 and the engagement location G between the external gear portion 39 and the internal gear portion 31. This three-point support restricts the rattling of the planetary gear 33 subject to the outside force f to the cover gear 12, preventing generation of abnormal noises due to tooth hit between the gear portions 39 and 31 together with the cancellation action of the above outside force f. In addition, since the receiving portion 64 of the spring member 70 is out of alignment with the eccentric direction line E and also the outer-peripheral-side contact portion 73 contacts the gear inner peripheral surface 42 at one location, it is prevented that the action line L is overlapped with the eccentric direction line E to destroy the three-point support. Accordingly, the preventive action to the generation of abnormal noises takes effect for a long period time. Further, the elastic force F acts on the external gear portion 39 to be pushed toward the internal gear portion 31 and therefore, the external gear portion 39 is securely engaged with the internal gear portion 31, thus improving working efficiency and responsiveness.

Further, when the changing torque is increased to the positive torque side, the planetary gear 33 performs the planetary motion while approaching the gear inner peripheral surface 42 to the end portion closer to the eccentric direction line E of the outer-peripheral-side contact portion 73. At this point, the free end 76 is formed with the end portion remote from the eccentric direction line E of the outer-peripheral-side contact portion 73 and is concaved in an inner side from the contact location with the gear inner peripheral surface 42 of the outer-peripheral-side contact portion 73 on the basis of the relation in dimension between the curvature radii Rc and Rd. Therefore, the free end is difficult to be engaged with the gear inner peripheral surface 42. Further, at this point, with respect to the spring member 70, the contact location with gear inner peripheral surface 42 of the outer-peripheral-side contact portion 73 is shifted to the connecting portion 74 and at the same time, the connecting portion 74 is flexibly deformed. Therefore, even if the compression of the spring member 70 is increased, an increase of an internal stress in the connection portion 74 is restricted, improving fatigue resistance strength.

Moreover, when the changing torque becomes the maximum positive torque $T_+$, the gear inner peripheral surface 42 is closest to the end portion close to the eccentric direction line E of the outer-peripheral-side contact portion 73 and an elastic deforming amount becomes at a maximum, therefore obtaining the maximum elastic force F. Accordingly, the three-point support of the planetary gear 33 is maintained against the outside force $f_+$ due to the maximum positive torque $T_+$ and also the cancellation action due to the elastic force F is maximized. In addition, even if the outside force f acting on the planetary gear 33 exceeds an outside force $f_+$ due to the maximum positive torque $T_+$, a compression stroke of the spring member 70 can be limited by contact of the gear inner peripheral surface 42 with the eccentric outer peripheral surface 40. Accordingly, this further improves fatigue resistance strength of the spring member 70.

The spring member 70 is configured in such a manner that the outer-peripheral-side contact portions 72 and 73 and the connecting portion 74 are connected in a U-letter shape, whereby the spring member 70 is difficult to be shifted upon compression thereof. In addition, the spring member 70 is arranged to be contacted at two locations between the inner-peripheral-side contact portion 72 and the receiving portion 64, thereby being stably supported by the receiving portion 64. These arrangements allow a wear between the spring member 70 and the receiving portion 64 to be sufficiently restricted. Further, the bending portion 75 and the connecting portion 74 in the spring member 70 are respectively opposed to and spaced from the inner side faces 67 and 68 of the receiving portion 64 and therefore, both sides of the spring member 70 in the reference circumferential direction are not restricted. As a result, an increase of the internal stress can be restricted to improve fatigue resistance strength. Further, the bending portion 75 and the connecting portion 74 are arranged as opposed to the inner side faces 67 and 68 and therefore, even if the spring member 70 is shifted due to a friction with the planetary gear 33 performing a planetary motion, the shift can be limited by engagement of each portion 75 and 74 to each inner side face 67 and 68. In addition, the spring member 70 is retained to be pressed between the snap ring 62 and the concave portion 60 and thereby, the axial shift, i.e., the wear with the planetary gear 33 is restricted.

Second Embodiment

Figure 9:
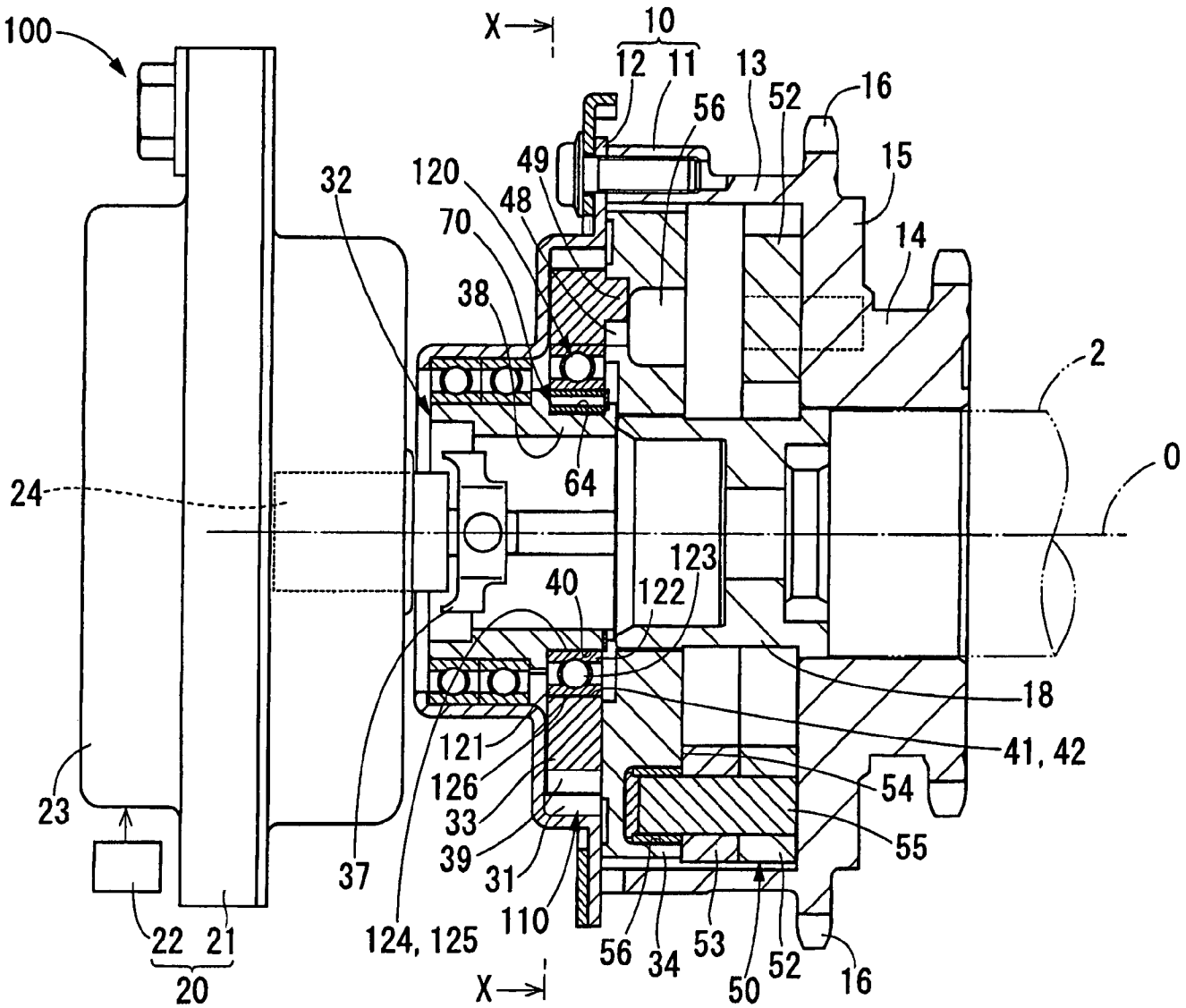
FIG. 9 is a cross section corresponding to FIG. 2, showing a valve timing controller in a second embodiment of the present invention.
Figure 10:
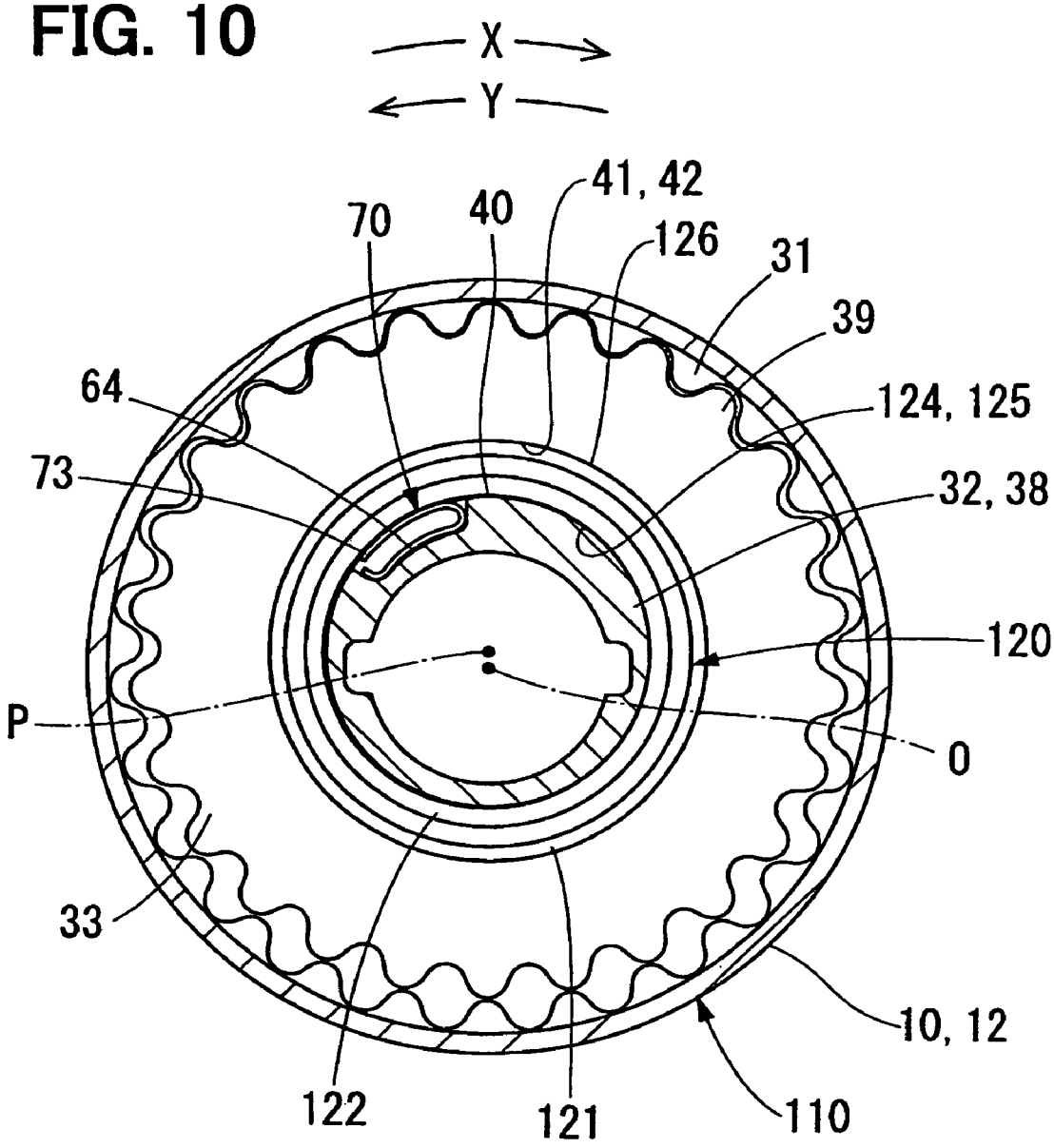
FIG. 10 is a cross section taken on line X-X in FIG. 9.

As shown in FIGS. 9 and 10, a second embodiment of the present invention is a modification of the first embodiment.

In a differential gear mechanism 110 of a valve timing controller 100 in the second embodiment, a planetary bearing 120 is added between the gear inner peripheral surface 42 of the planetary gear 33 and the eccentric outer peripheral surface 40 of the eccentric cam portion 38. The planetary bearing 120 is a radial bearing holding ball-shaped rolling elements 123 between an outer ring 121 and an inner ring 122. An outer periphery 126 of the outer ring 121 is press-fitted into the gear inner peripheral surface 42 to rotate integrally with the planetary gear 33 and on the other hand, an inner peripheral surface 125 of a central bore 124 of the inner ring 122 is slidably and rotatably engaged with the eccentric outer peripheral surface 40. A clearance due to a manufacturing tolerance or the like is formed in the engagement boundary face between the inner peripheral surface 125 and the eccentric outer peripheral surface 40 (not shown). Accordingly, also in the second embodiment, the planetary gear 33 can perform a planetary motion while engaging through the external gear portion 39 to the internal gear portion 31.

In the second embodiment with the above structure, an elastic force F is applied to the inner peripheral surface 125 of the planetary bearing 120 in such a manner that the action line L is inclined within the angle region θ to the eccentric direction line E and has the opposing direction to the direction of the outside force $f_+$ at the time of the maximum positive torque $T_+$. Accordingly, on the basis of the principle the same as the first embodiment, the cancellation action of the outside force f to which the planetary gear 33 and the planetary bearing 120 are subject and the three-point support action between the planetary gear 33 and the planetary bearing 120 are achieved to prevent generation of the abnormal noises.

Further, in the second embodiment, when the planetary gear 33 subject to the outside force f by the transmission of the changing torque performs a planetary motion, a rotational difference between the inner ring 122 and the outer ring 121 occurs by rolling of the rolling elements 123. Therefore, the inner peripheral surface 125 of the planetary bearing 120 is difficult to slide to the outer peripheral-side contact portion 73 of the spring member 70. As a result, a wear between the outer-peripheral-side contact portion 73 and the inner peripheral surface 125 can be prevented.

Third Embodiment

Figure 11A:
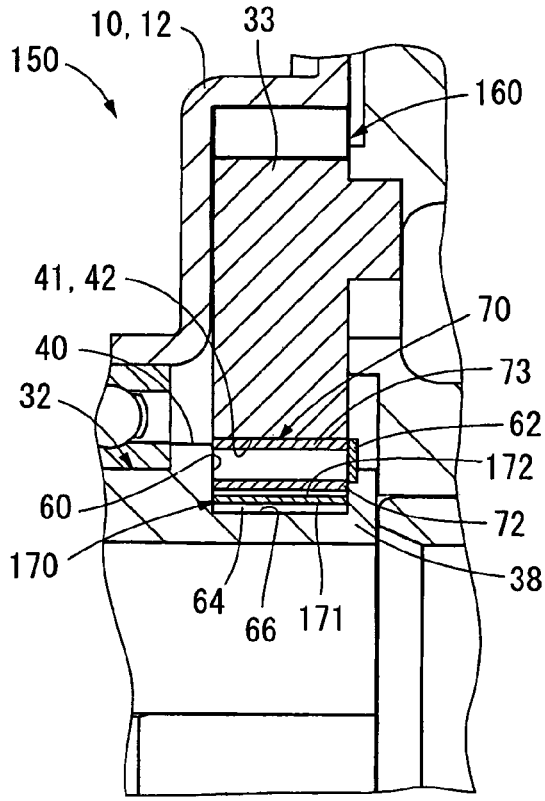
FIGS. 11A and 11B are cross sections corresponding to FIGS. 6A and 6B, showing a valve timing controller in a third embodiment of the present invention.
Figure 11B:
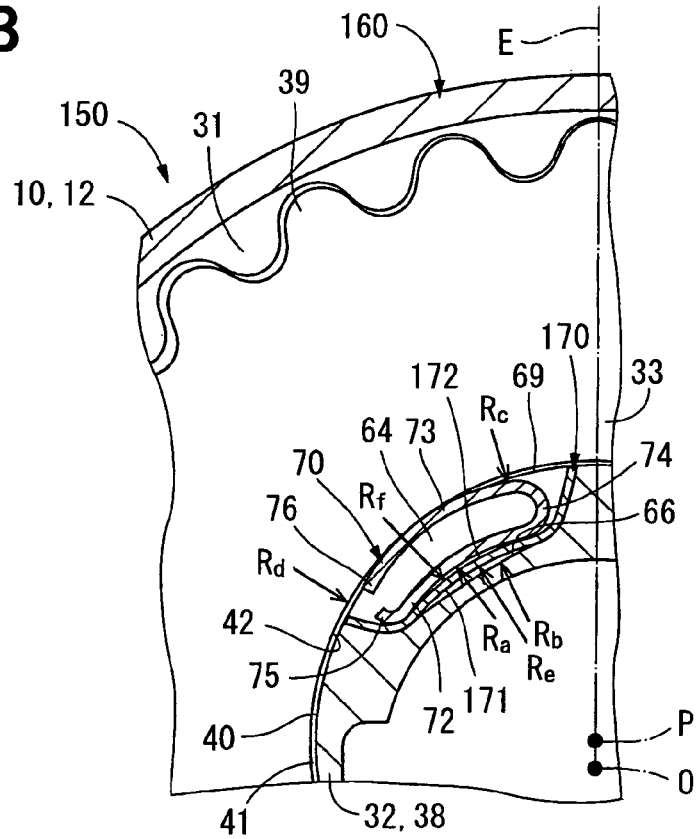

As shown in FIGS. 11A and 11B, a third embodiment of the present invention is a modification of the first embodiment.

In a differential gear mechanism 160 of a valve timing controller 150 in the third embodiment, a washer member 170 is added as a part of the planetary carrier 32 between the receiving portion 64 of the eccentric cam portion 38 and the spring member 70. The washer member 170 is made of a metallic sheet or the like and mostly has a circular cross section bent along the inner-peripheral-side contact portion 72 of the spring member 70 and the inner bottom face 66 of the receiving portion 64. A curvature radius $R_e$, $R_f$ of each of an inner peripheral surface 171 and an outer peripheral surface 172 of the washer member 170 is set to be smaller than a curvature radius $R_b$ of the inner bottom surface 66 of the receiving portion 64 and larger than a curvature radius $R_a$ of the inner-peripheral-side contact portion 72. Thereby, the inner peripheral surface 171 of the washer member 170 is in contact with the inner bottom surface 66 of the receiving portion 64 at two locations in the reference circumferential direction and the outer peripheral surface 172 of the washer member 170 is in contact with the inner-peripheral-side contact portion 72 at two locations in the reference circumferential direction. Accordingly, the washer member 170 can stably support the inner-peripheral-side contact portion 72 in a state of being stably supported by the receiving portion 64, thereby restricting a wear between the spring member 70 and the washer member 170.

In the differential gear mechanism 160, the washer member 170 is arranged as spaced from both sides of the spring member 70 in the reference circumferential direction. With this, the spring member 70 is not restrained at both sides thereof in the reference circumferential direction and an increase of the internal stress is restricted, thus achieving a high fatigue resistance strength.

Fourth Embodiment

Figure 12A:
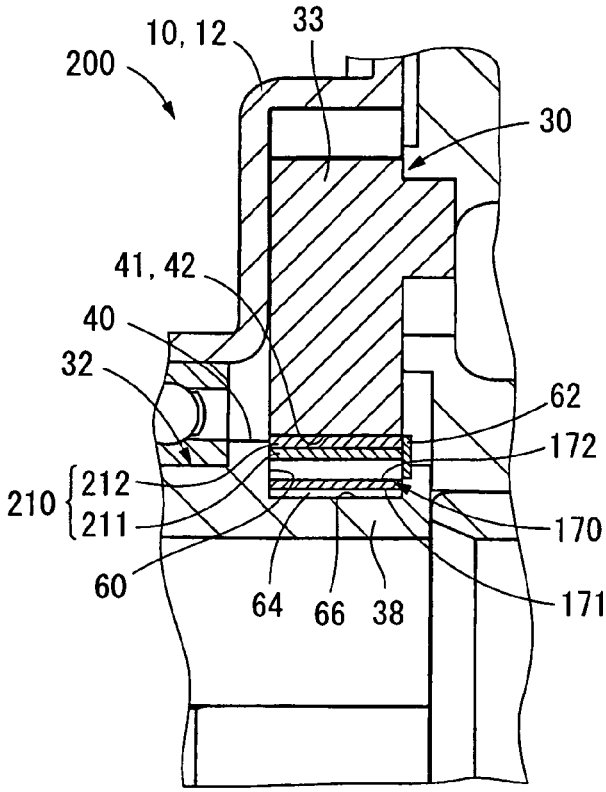
FIGS. 12A and 12B are cross sections corresponding to FIGS. 6A and 6B, showing a valve timing controller in a fourth embodiment of the present invention.
Figure 12B:
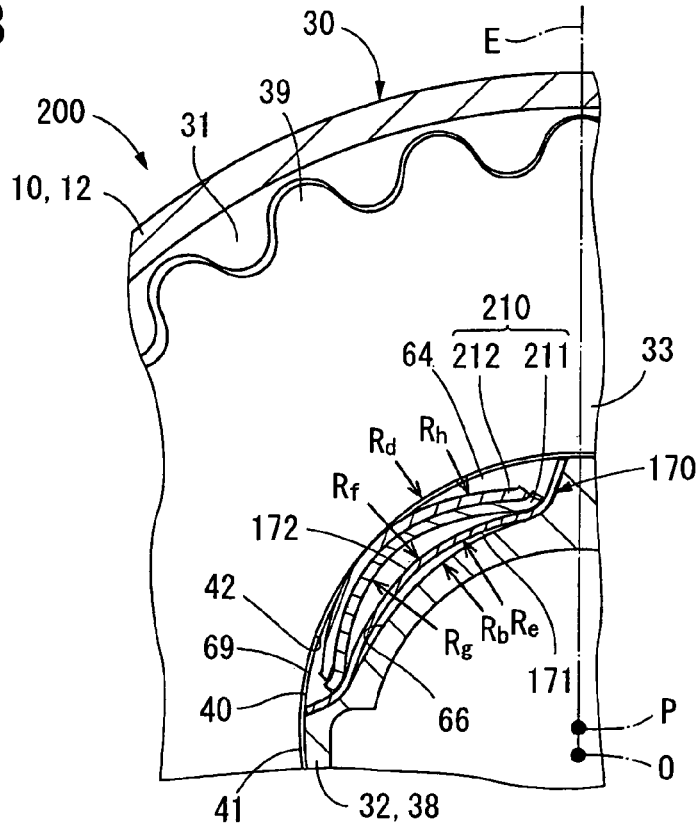

As shown in FIGS. 12A and 12B, a fourth embodiment of the present invention is a modification of the third embodiment.

In a valve timing controller 200 in the fourth embodiment, in place of the substantially U-letter shaped spring member 70, a leaf spring 210 is provided between the eccentric cam portion 38 and the central bore 41 of the planetary gear 33. In more detail, the leaf spring 210 is composed of two spring plates 211 and 212 and received in the receiving portion 64 of the eccentric cam portion 38 to be pressed and retained between the snap ring 62 and the concave portion 60. Each of the spring plates 211 and 212 has an arc cross section as bent along the gear inner peripheral surface 42 of the planetary gear 33 and forms a clearance to the washer member 170 in the receiving portion 64 at both sides in the reference circumferential direction.

The innermost peripheral spring plate 211 in the leaf spring 210 contacts the outer peripheral surface 172 of the washer member 170. Here, a curvature radius $R_g$ of the spring plate 211 is set to be smaller than a curvature radius $R_f$ of the outer peripheral surface 172 of the washer member 170. Thereby, the spring plate 211 is in contact with the outer peripheral surface 172 at two locations in the reference circumferential direction.

The outermost peripheral spring plate 212 in the leaf spring 210 extends through the eccentric outer peripheral surface 40 from the opening 69 of the receiving portion 64 and contacts the gear inner peripheral surface 42. Here, a curvature radius $R_h$ of the spring plate 212 is set to be smaller than a curvature radius $R_d$ of the gear inner peripheral surface 42. Thereby, the spring plate 212 is in contact with the gear inner peripheral surface 42 at one location in the reference circumferential direction.

Figure 13:
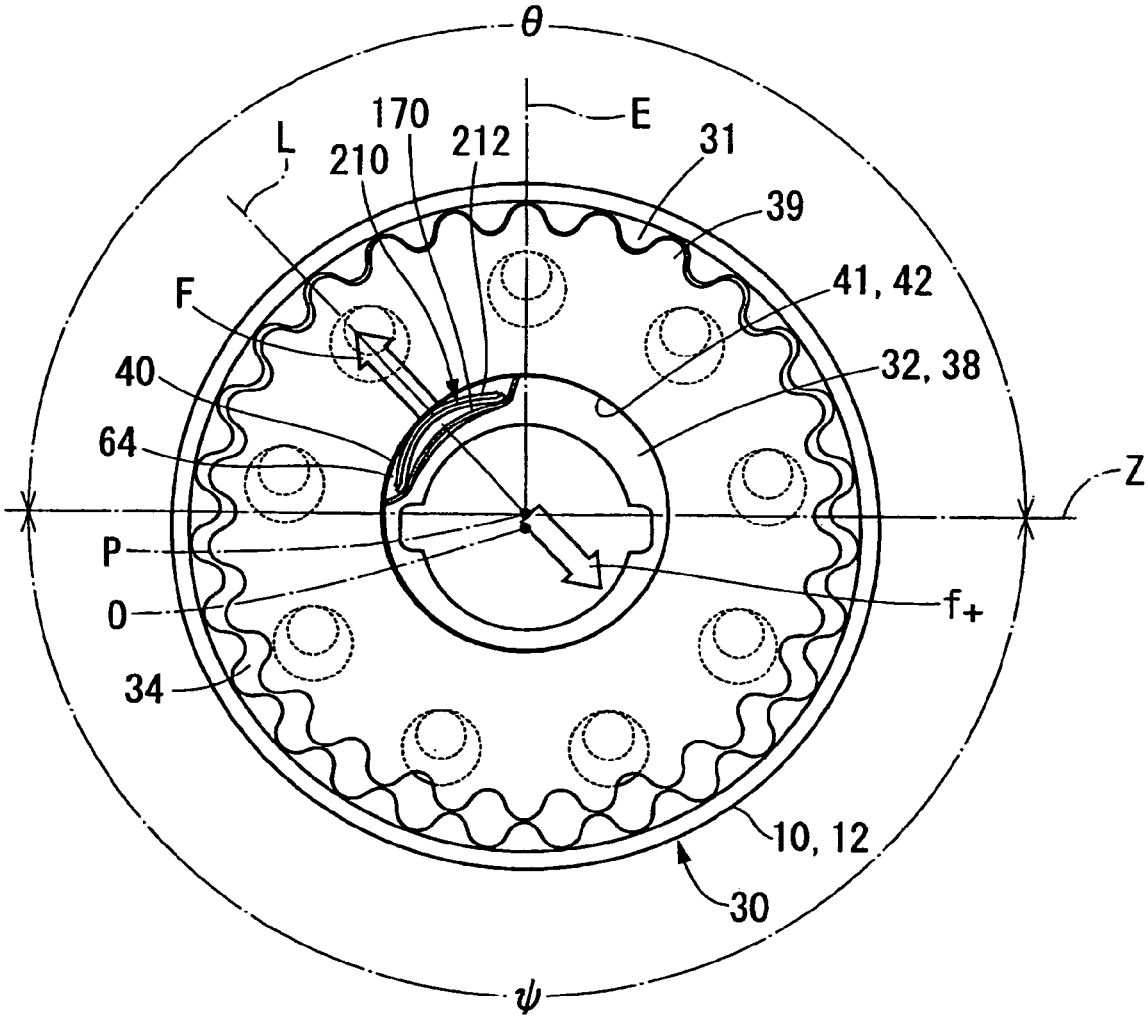
FIG. 13 is a diagram for explaining the feature of a valve timing controller shown in FIGS. 12A and 12B.

The leaf spring 210 with the above structure is compressed between the outer peripheral surface 172 of the washer member 170 and the gear inner peripheral surface 42 to flexibly deform each leaf spring 211 and 212, thereby generating an elastic force F. The leaf spring 210 applies the generated elastic force F to a contact location with the leaf spring 212 in the gear inner peripheral surface 42 as shown diagrammatically in FIG. 13, thereby pressing the gear inner peripheral surface 42. At this point, the elastic force F is generated in such a manner that the action line L is inclined within the angle region α to the eccentric direction line E and the elastic force F has the opposing direction to the direction of the outside force $f_+$ at the time of the maximum positive torque $T_+$. Accordingly, also in the fourth embodiment, the cancellation action of the outside force f to which the planetary gear 33 is subject and the three-point support action of the planetary gear 33 are achieved to prevent generation of the abnormal noises.

In the fourth embodiment, since the leaf spring 210 is received in the receiving portion 64 and is out of alignment with the eccentric direction line E and the leaf spring 212 contacts the gear inner peripheral surface 42 at one location, it is prevented that the action line L is overlapped with the eccentric direction line E to destroy the three-point support. Further, in the leaf spring 210, the spring plate 211 is in contact with the washer member 170 in the receiving portion 64 at two locations, whereby the leaf spring 120 is stably supported, restricting the wear between the spring plate 211 and the washer member 170. Further, the leaf spring 210 can reduce an internal stress generated in each spring plate 211 and 212 at the compression time, therefore improving fatigue resistance strength.

Fifth Embodiment

Figure 14:
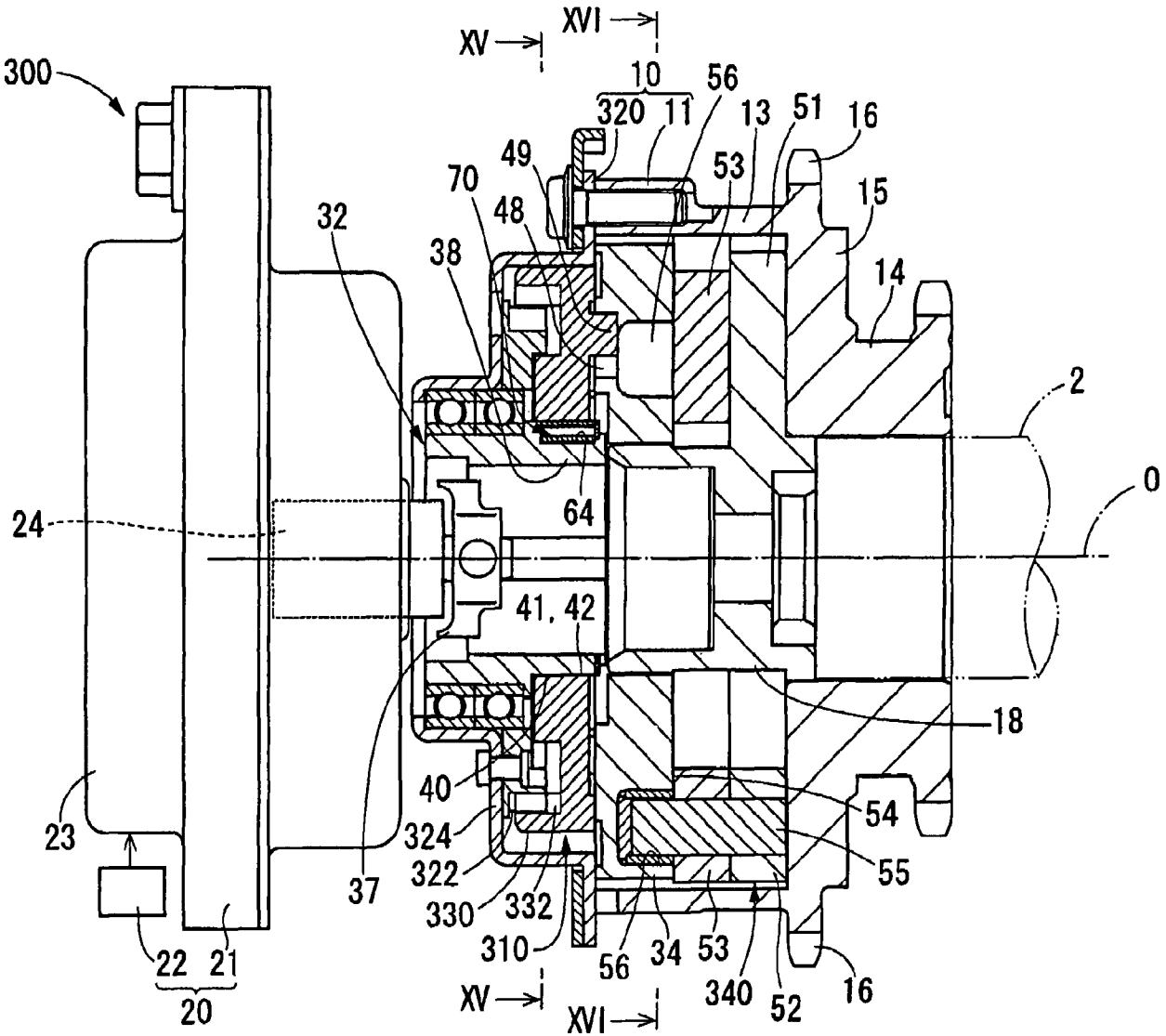
FIG. 14 is a cross section corresponding to FIG. 2, showing a valve timing controller in a fifth embodiment of the present invention.

As shown in FIG. 14, a fifth embodiment of the present invention is a modification of the first embodiment.

In a differential gear mechanism 310 of a valve timing controller 300 in the fifth embodiment, a cover gear 320 of the drive-side rotational element 10 includes an external gear portion 322 in place of the internal gear portion 31 and a planetary gear 330 includes an internal gear portion 332 in place of the external gear portion 39.

In more detail, the cover gear 320 is composed of a combination of a cover portion 324 having the substantially same structure with the cover gear 12 in the first embodiment except for absence of the internal gear portion 31 and a separate external gear portion 322. The external gear portion 322 is riveted coaxially to the cover portion 324 for caulking and serves as a part of the drive-side rotational element 10.

Figure 15:
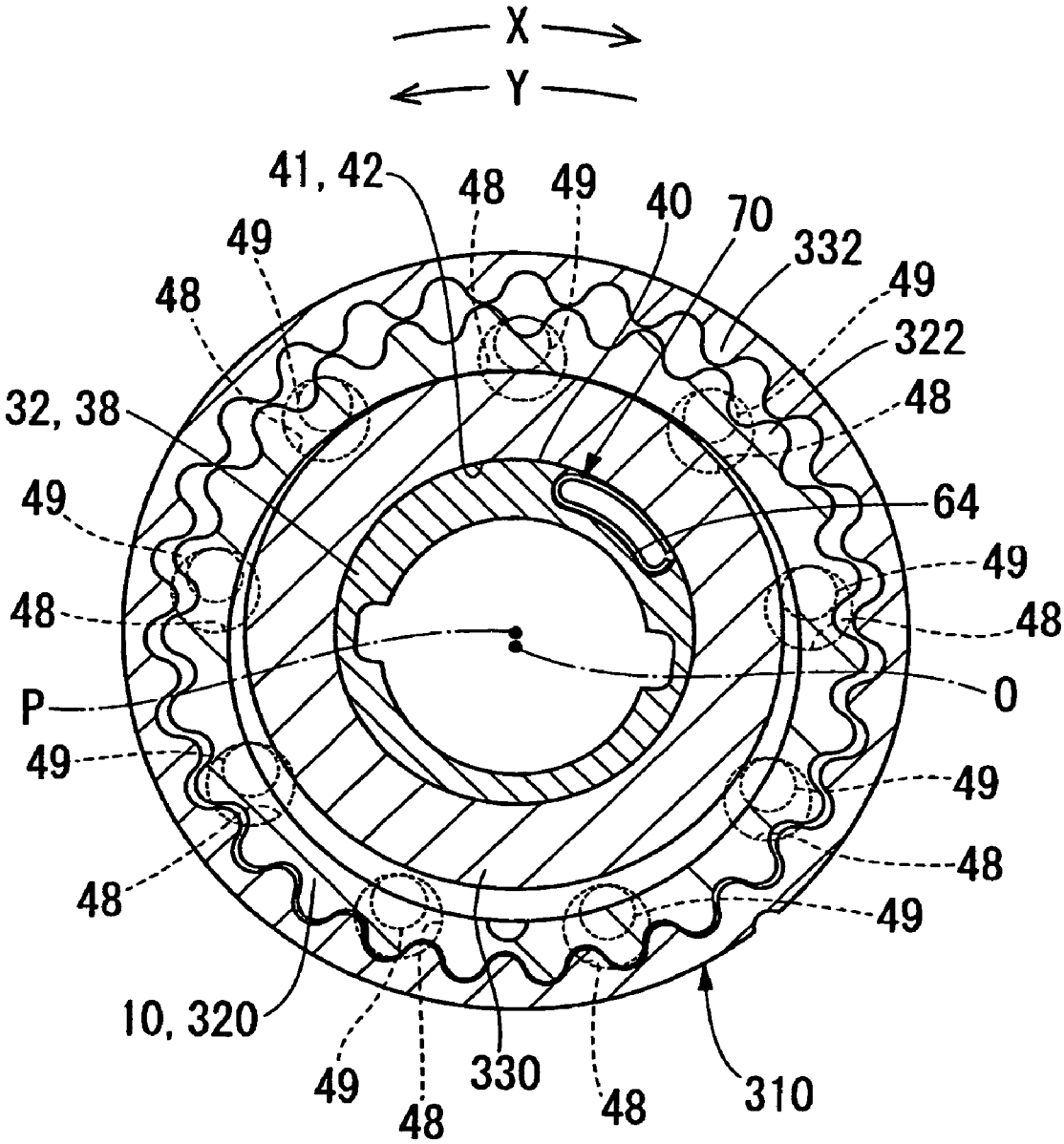
FIG. 15 is a cross section taken on line XV-XV in FIG. 14.

As shown in FIGS. 14 and 15, the root circle in the internal gear portion 332 of the planetary gear 330 is larger than the tip circle of the external gear portion 322 and the tooth number of the internal gear portion 332 is by one less than that of the external gear portion 322. The internal gear portion 332 of the planetary gear 330 is located coaxially with the central bore 41 engaging to the eccentric outer peripheral surface 40. Accordingly, the internal gear portion 332 is eccentric to the rotational central line O and located in an outer peripheral side of the external gear portion 322 and engaged with the external gear portion 322 at a side opposed to the eccentric side. That is, the planetary gear 330 together with the cover gear 320 constitute the differential gear mechanism 310 with the internal gear engagement structure and can perform a planetary motion while engaging to the external gear portion 322.

In the differential gear mechanism 310 with the above structure, when the planetary carrier 32 rotates relatively in the advance direction X to the drive-side rotational element 10, the planetary gear 330 performs a planetary motion while changing an engagement tooth thereof with the external gear portion 322 in the circumferential direction. Thereby, a force with which the engagement projection 49 presses the engagement bore 48 in the rotational direction increases. As a result, the transmission rotational element 34 rotates relatively in the retard direction Y to the drive-side rotational element 10. On the other hand, when the planetary carrier 32 rotates relatively in the retard direction Y to the drive-side rotational element 10, the planetary gear 330 performs a planetary motion while changing an engagement tooth thereof with the external gear portion 322 in the circumferential direction. Thereby, the engagement projection 49 presses the engagement bore 48 in the counter-rotational direction. As a result, the transmission rotational element 34 rotates relatively in the retard direction Y to the drive-side rotational element 10. Thus, the differential gear mechanism 310 generates the planetary motion of the planetary gear 330 due to the relative rotational motion of the planetary carrier 32 to the drive-side rotational element 10 to convert the planetary motion into the relative rotational motion of the transmission rotational element 34 to the drive-side rotational element 10. A relation between the relative rotational direction of the planetary carrier 32 and the relative rotational direction of the transmission rotational element 34 is in reverse to that in the first embodiment.

It should be noted that, when the planetary carrier 32 does not rotate relatively to the drive-side rotational element 10, the planetary gear 330 does not perform the planetary motion the same as in the first embodiment and the transmission rotational element 34 rotates while maintaining the relative rotational phase to the drive-side rotational element 10.

Figure 16:
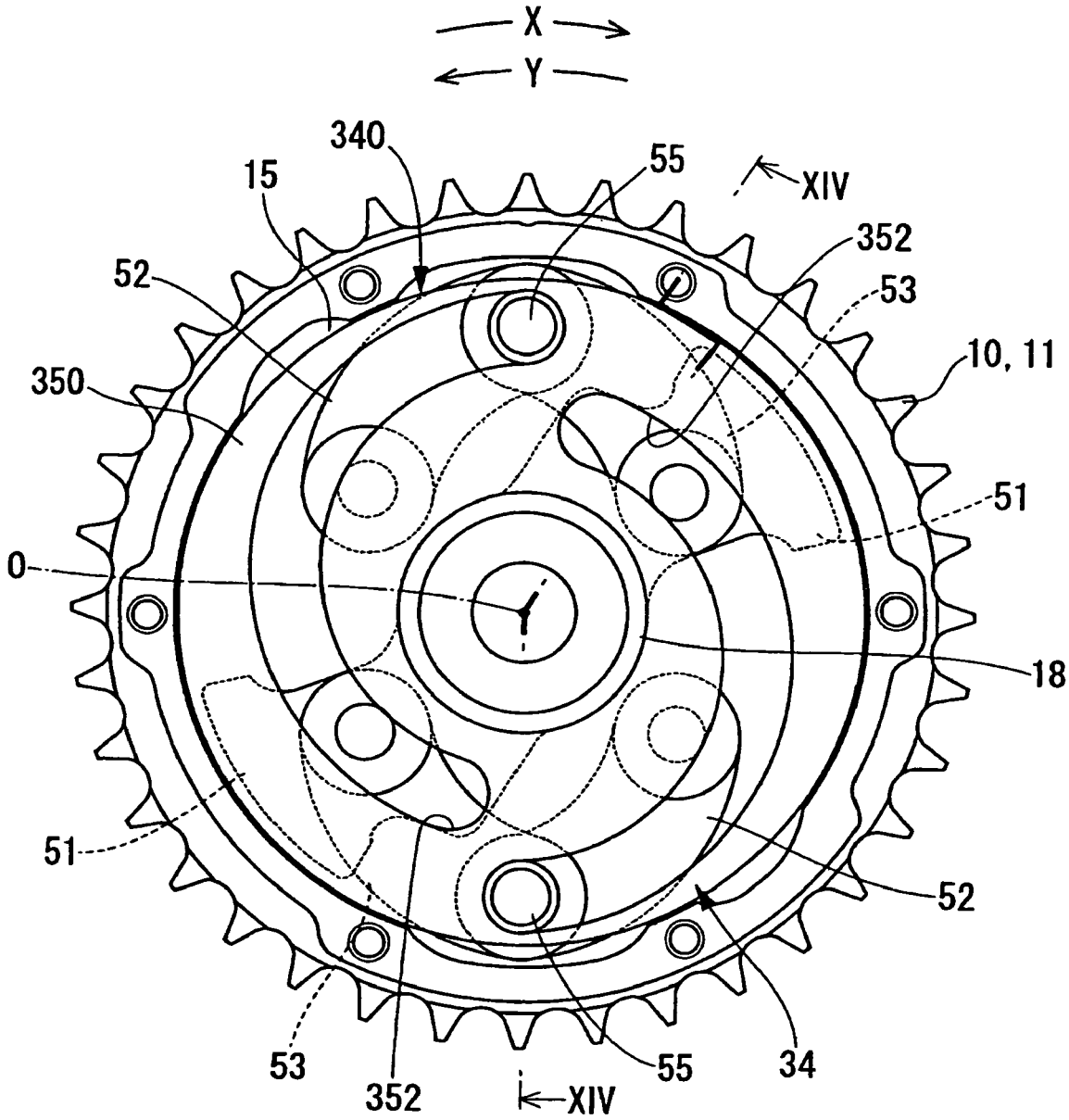
FIG. 16 is a cross section taken on line XVI-XVI in FIG. 14.

As shown in FIGS. 14 and 16, in the valve timing controller 300, each guide passage 352 of the guide rotational portion 350 in the link mechanism 340 extends at an outer peripheral side of the rotational central line O and is formed in a curve shape where a distance from the rotational central line O to the guide passage 352 changes to be larger as it goes toward the direction X. Therefore, When in the link mechanism 340, the transmission rotational element 34 rotates relatively in the advance direction X to the drive-side rotational element 10, the movable shaft element 55 slides in the guide passage 352 to a side where it comes closer to the rotational central line O. Since the pair elements of the second and third links 52 and 53 forming the turning pair by this come closer to the rotational central line O, the first link 51 and the driven-side rotational element 18 rotate relatively in the advance direction X to the drive-side rotational element 10 to advance the engine shaft phase. On the other hand, when the transmission rotational element 34 rotates relatively in the retard direction Y to the drive-side rotational element 10, the movable shaft element 55 slides in the guide passage 352 to a side where it distances itself from the rotational central line O. Since the pair elements of the second and third links 52 and 53 thereby forming the turning pair distance themselves from the rotational central line O, the first link 51 and the driven-side rotational element 18 rotate relatively in the retard direction Y to the drive-side rotational element 10 to retard the engine shaft phase. Thus in the link mechanism 340, the relative rotational motion to the drive-side rotational element 10 of the transmission rotational element 34 is converted into the relative rotational motion to the drive-side rotational element 10 of the driven-side rotational element 18 to change the engine shaft phase. A relation between the relative rotational direction of the transmission rotational element 34 and the relative rotational direction of the driven-side rotational element 18 is in reverse to that in the first embodiment.

It should be noted that, when the transmission rotational element 34 does not rotate relatively to the drive-side rotational element 10, the movable shaft element 55 does not slide in the guide passage 352 the same as in the first embodiment and the driven-side rotational element 18 rotates while maintaining the relative rotational phase to the drive-side rotational element 10, thereby maintaining the engine shaft phase.

Figure 17:
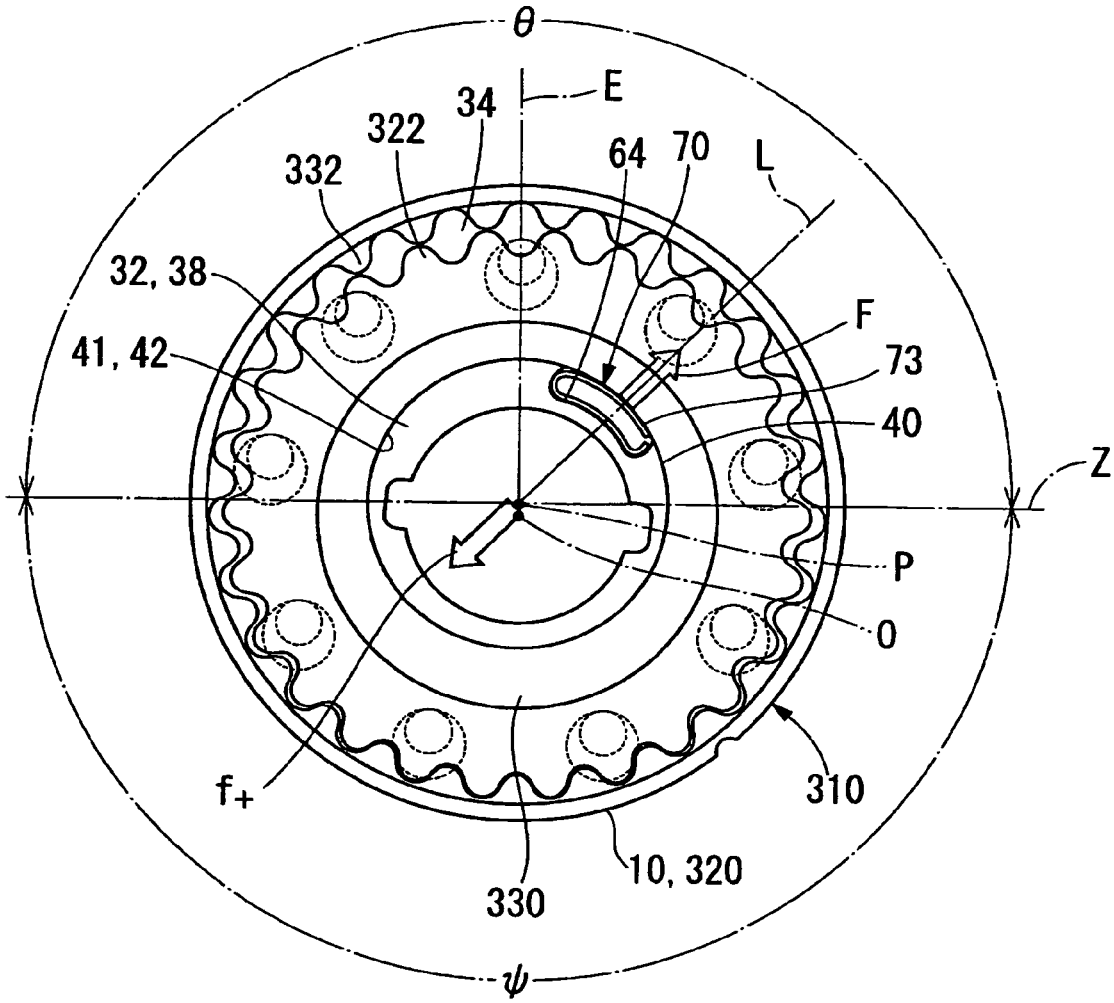
FIG. 17 is a diagram for explaining the feature of a valve timing controller in FIG. 14.

In the fifth embodiment with the above structure, as shown in FIG. 17, the planetary gear 330 is subject to an outside force f in the direction within the angle region ψ in accordance with the changing torque of the camshaft 2. Therefore, also in the fifth embodiment, an elastic force F of the spring member 70 is applied to the gear inner peripheral surface 42 of the planetary gear 330 in such a manner that the action line L is inclined within the angle region θ to the eccentric direction line E and the elastic force F has the direction opposed to the direction of the outside force $f_+$ at the time of the maximum positive torque $T_+$. Accordingly, the outside force f can be sufficiently canceled out.

Figure 18:
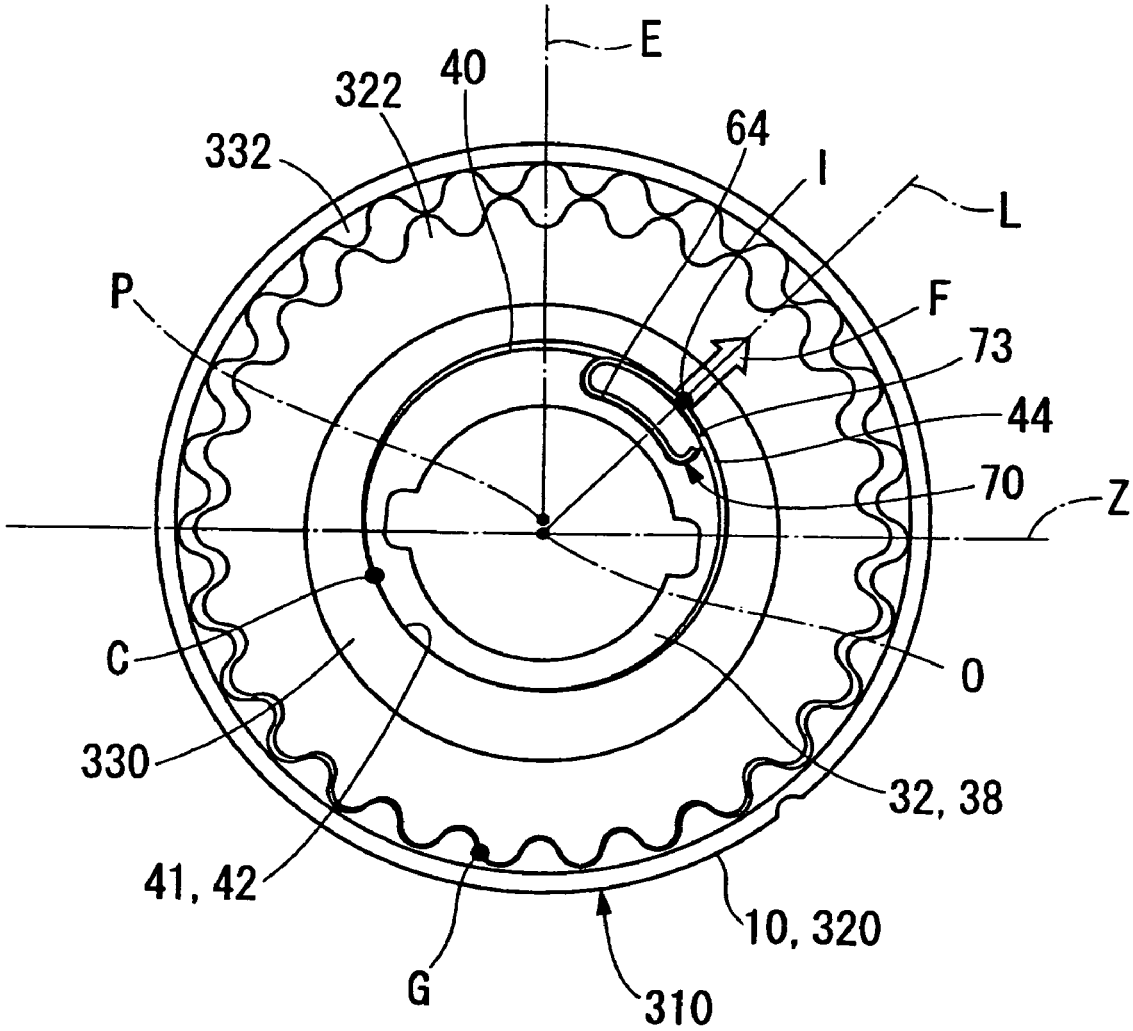
FIG. 18 is a diagram for explaining the feature of a valve timing controller shown in FIG. 14.

When the planetary gear 330 is, as shown in FIG. 18, subject to the elastic force F the action line of which is inclined to the eccentric direction line E, the planetary gear 330 rotates by the clearance amount 44 between the gear inner peripheral surface 42 and the eccentric outer peripheral surface 40 on the basis of the location G where the internal gear portion 332 and the external gear portion 322 are engaged. Therefore, the gear inner peripheral surface 42 contacts the eccentric outer peripheral surface 40 at a location C different from an intersection location I with the action line L. Accordingly, the planetary gear 330 is supported at three locations, i.e., the intersection location I between the gear inner peripheral surface 42 and the action line L, the contact location C between the gear inner peripheral surface 42 and the eccentric outer peripheral surface 40 and the engagement location G between the internal gear portion 332 and the external gear portion 322. This three-point support of the planetary gear 330 restricts the rattling of the planetary gear 330 to the cover gear 320, preventing generation of abnormal noises due to tooth hit between the gear portions 332 and 322.

Sixth Embodiment

Figure 19:
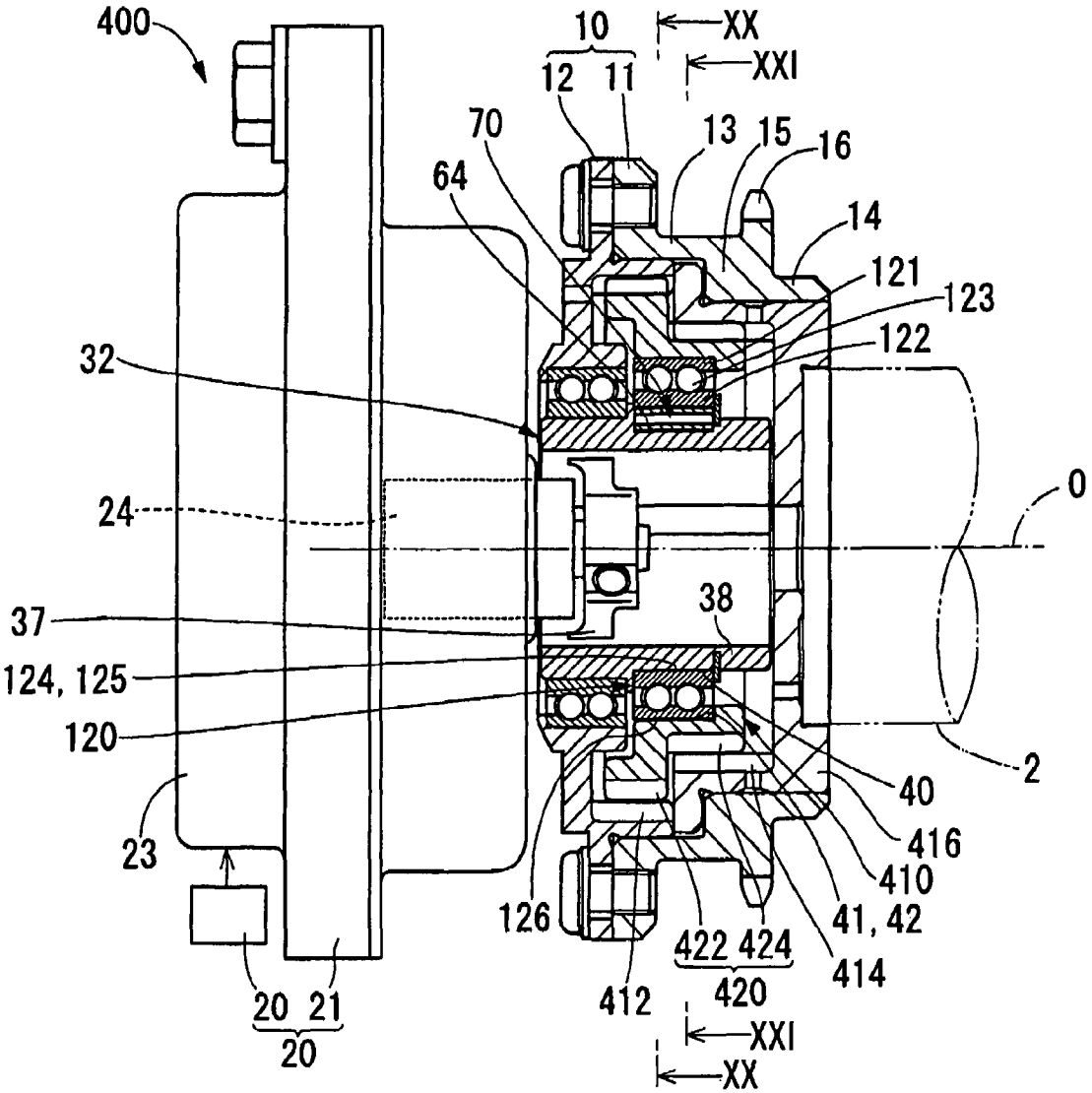
FIG. 19 is a cross section corresponding to FIG. 2, showing a valve timing controller in a sixth embodiment of the present invention.

As shown in FIG. 19, a sixth embodiment of the present invention is a modification of the second embodiment.

In a differential gear mechanism 410 of a valve timing controller 400 in the sixth embodiment, two internal gear portions 412 and 414 are provided in place of the transmission rotational element 34 and the link mechanism 50. Here, one drive-side internal gear portion 412 has the substantially same structure as the internal gear portion 31 in the first embodiment and serves as a part of the drive-side rotational element 10. In addition, the other driven-side internal gear portion 414 is formed at a side end portion opposed to the camshaft 2 of the driven-side rotational element 416 and is arranged coaxially with each rotational element 10 and 416 and is adjacent to the dive-side internal gear portion 412 in the axial direction. In the driven-side internal gear portion 414, a root circle thereof is set to be lower than a tip circle of the drive-side internal gear portion 412 and the tooth number is set to be smaller than the tooth number of the drive-side internal gear portion 412. The driven-side rotational element 416 in the sixth embodiment has substantially the same structure as the driven-side rotational element 18 in the first embodiment except that the opposing side end portion to the camshaft 2 does not engage with the transmission rotational element 34, but forms the driven-side internal gear portion 414.

Figure 20:
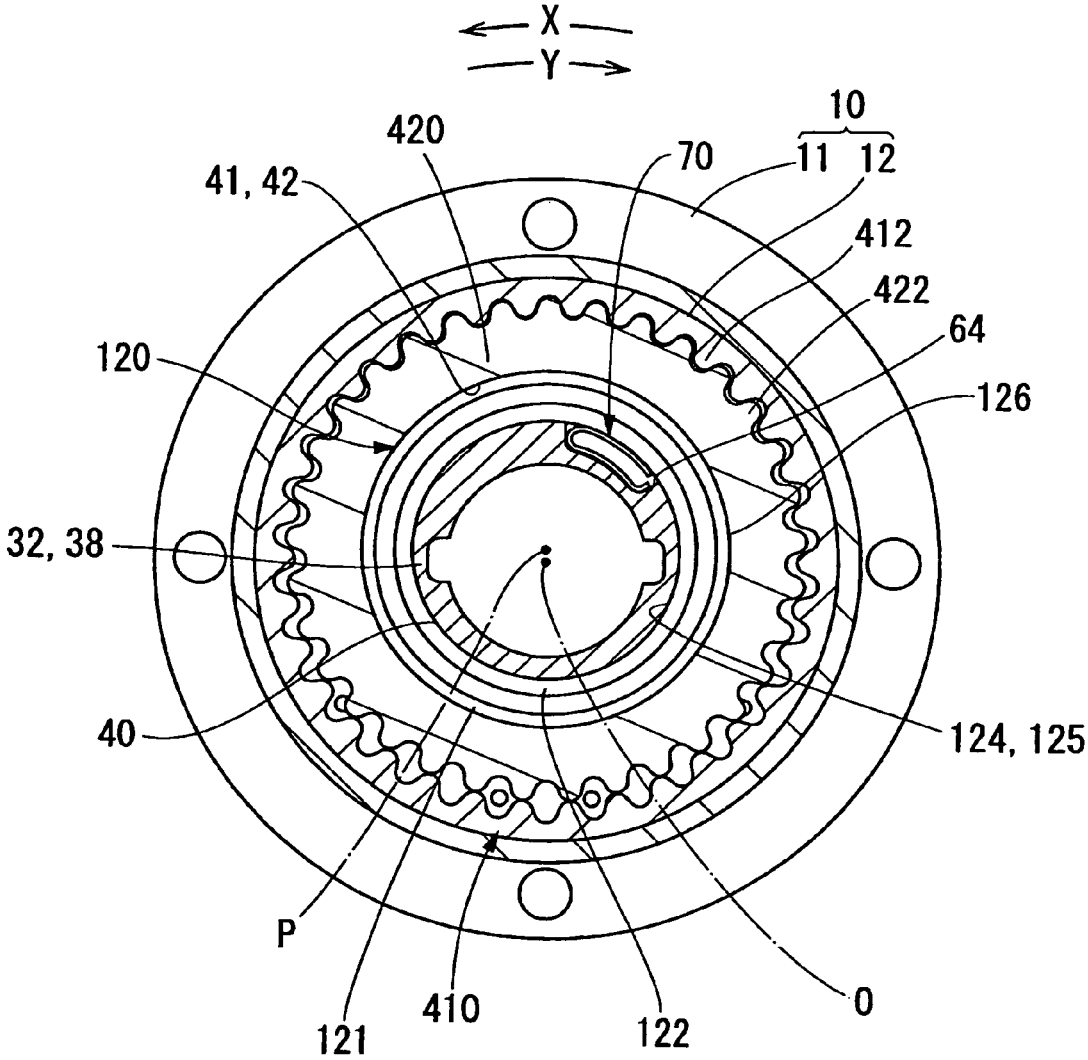
FIG. 20 is a cross section taken on line XX-XX in FIG. 19.
Figure 21:
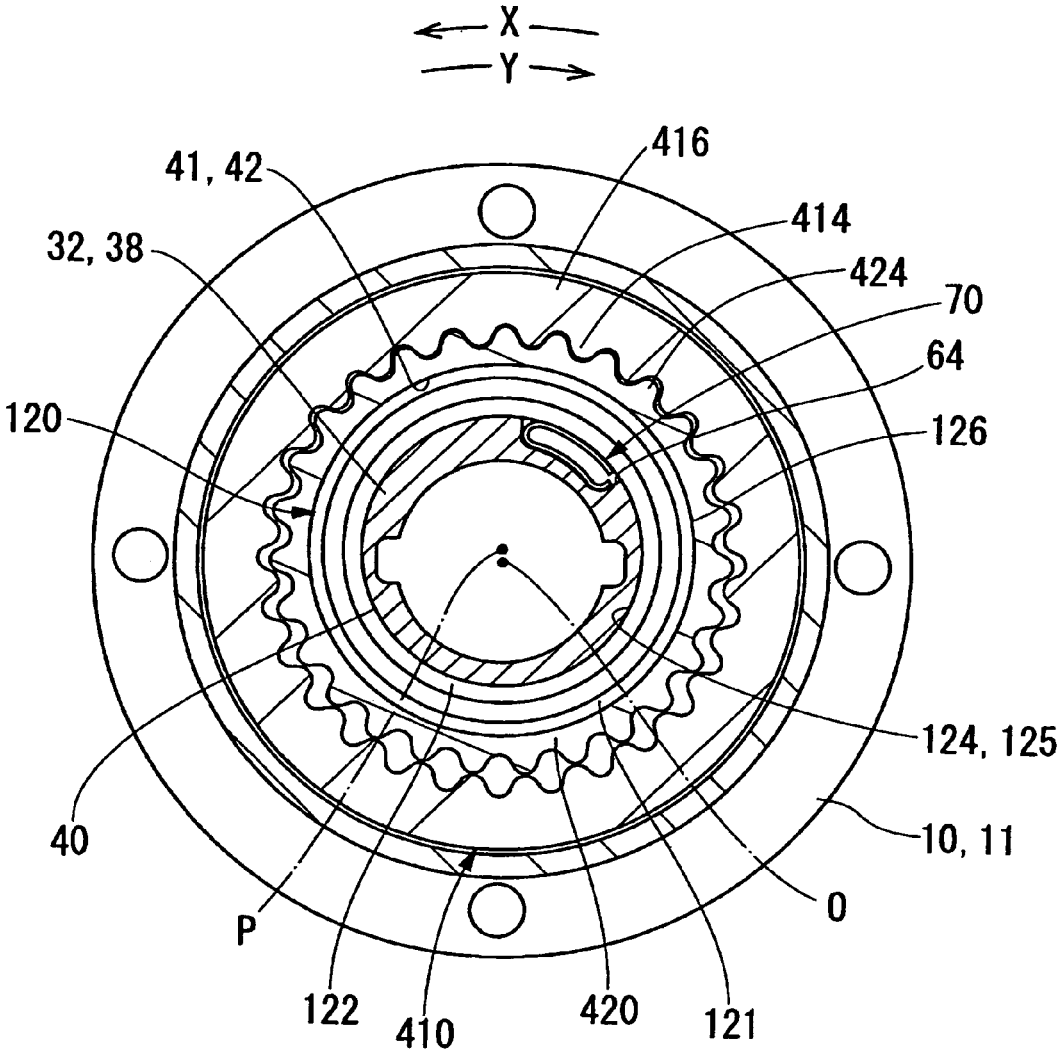
FIG. 21 is a cross section taken on line XXI-XXI in FIG. 19.

Further, in the differential gear mechanism 410, the planetary gear 420 having a two-step cylindrical shape is provided with two external gear portions 422 and 424. One drive-side external gear portion 422 is, as shown in FIGS. 19 and 20, located in an inner peripheral side of the drive-side internal gear portion 412 and is formed of a large-diameter portion of the planetary gear 420 and the tooth number is set to be smaller by one than that of the drive-side internal gear portion 412. On the other hand, the other driven-side external gear portion 424 is, as shown in FIGS. 19 and 21, located in an inner peripheral side of the driven-side internal gear portion 414 and is formed of a small-diameter portion of the planetary gear 420 and the tooth number is set to be smaller by one than that of the driven-side internal gear portion 414. That is, the tooth number of the driven-side external gear portion 424 is set to be smaller than that of the drive-side external gear portion 422. As shown in FIGS. 19 to 21, the drive-side external gear portion 422 and the driven-side external gear portion 424 are eccentric at the same side to the rotational central line O with each other and respectively are engaged at the eccentric side to the drive-side internal gear portion 412 and the driven-side internal gear portion 414. That is, the planetary gear 420 together with the internal gear portions 412 and 414 constitutes the differential gear mechanism 410 of an internal tooth engagement state. In the same way as in the case of the second embodiment, in the sixth embodiment, a planetary bearing 120 is added between the gear inner peripheral surface 42 of the planetary gear 420 and the eccentric outer peripheral surface 40 of the eccentric cam portion 38. Accordingly, the planetary gear 420 can perform a planetary motion while engaging to the internal gear portions 412 and 414. In addition, in the sixth embodiment, a spring member 70 is provided over both an inner peripheral side of the drive-side external gear portion 422 and an inner peripheral side of the driven-side external gear portion 424. Accordingly, the spring member 70 can press both of the drive-side external gear portion 422 and the driven-side external gear portion 424 to the outer peripheral side.

In the differential gear mechanism 410 with the above structure, when the planetary carrier 32, does not rotate relatively to the drive-side rotational element 10, the planetary gear 420 does not perform the planetary motion and rotates with the rotational elements 10 and 416. As a result, a relative rotational phase between rotational elements 10 and 416, i.e., the engine shaft phase is maintained.

When the planetary carrier 32 rotates relatively in the advance direction X to the drive-side rotational element 10, the planetary gear 420 performs a planetary motion while changing an engagement tooth thereof with the internal gear portions 412 and 414 in the circumferential direction. Thereby, the driven-side rotational element 416 rotates relatively in the advance direction X to the drive-side rotational element 10 to advance the engine shaft phase. On the other hand, when the planetary carrier 32 rotates relatively in the retard direction Y to the drive-side rotational element 10, the planetary gear 420 performs a planetary motion while changing an engagement tooth thereof with the internal gear portions 412 and 414 in the circumferential direction. Thereby, the driven-side rotational element 416 rotates relatively in the retard direction Y to the drive-side rotational element 10 to retard the engine shaft phase. Thus the differential gear mechanism 410 generates the planetary motion of the planetary gear 420 due to the relative rotational motion of the planetary carrier 32 to the drive-side rotational element 10 to convert the planetary motion into the relative rotational motion of the driven-side rotational element 18 to the drive-side rotational element 10, thereby changing the engine shaft phase.

In the sixth embodiment with the above structure, the planetary gear 420 subject to the elastic force F the action line of which is inclined to the eccentric direction line E through the planetary bearing 120, the planetary gear 420 rotates by the clearance amount between a bearing inner peripheral surface 125 and the eccentric outer peripheral surface 40 on the basis of the location where the external gear portion 422 and the internal gear portion 412 are engaged or where the external gear portion 424 and the internal gear portion 414 are engaged. Therefore, the bearing inner peripheral surface 125 contacts the eccentric outer peripheral surface 40 at a location different from an intersection location with the action line L. Accordingly, the planetary gear 420 is to be supported at three locations, i.e., the intersection location between the bearing inner peripheral surface 125 and the action line L, the contact location between the bearing inner peripheral surface 125 and the eccentric outer peripheral surface 40 and the engagement location between the external gear portion 422 and the internal gear portion 412 or between the external gear portion 424 and the internal gear portion 414. This three-point support of the planetary gear 420 restricts the rattling of the planetary gear 420 to the internal gear portion 412 or 414, preventing generation of abnormal noises due to tooth hit between the gear portions 422 and 412 or between the gear portions 424 and 414.

Seventh Embodiment

Figure 22:
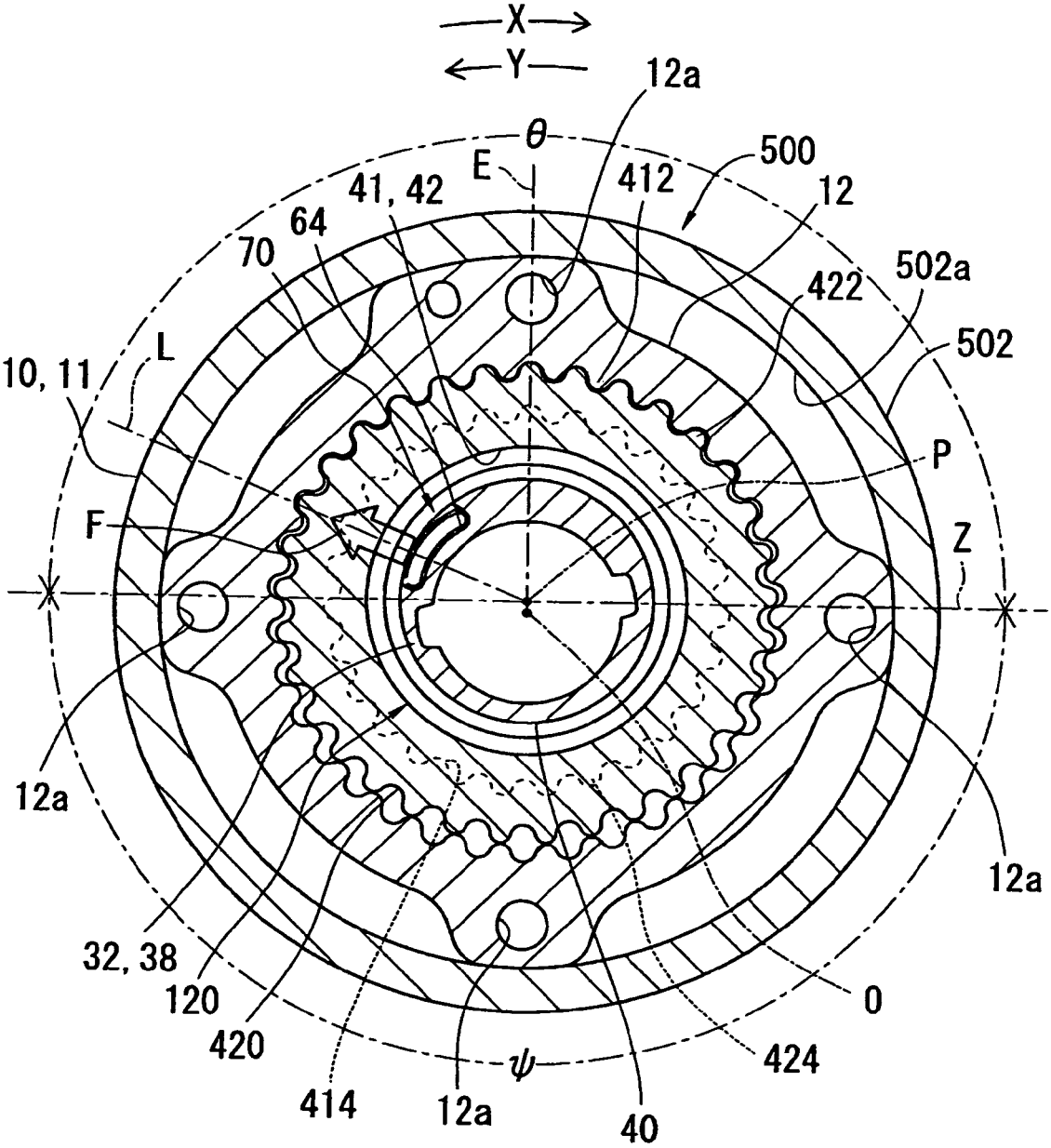
FIG. 22 is a cross section taken on line XXII-XXII in FIG. 24, showing a valve timing controller in a seventh embodiment of the present invention.
Figure 24:
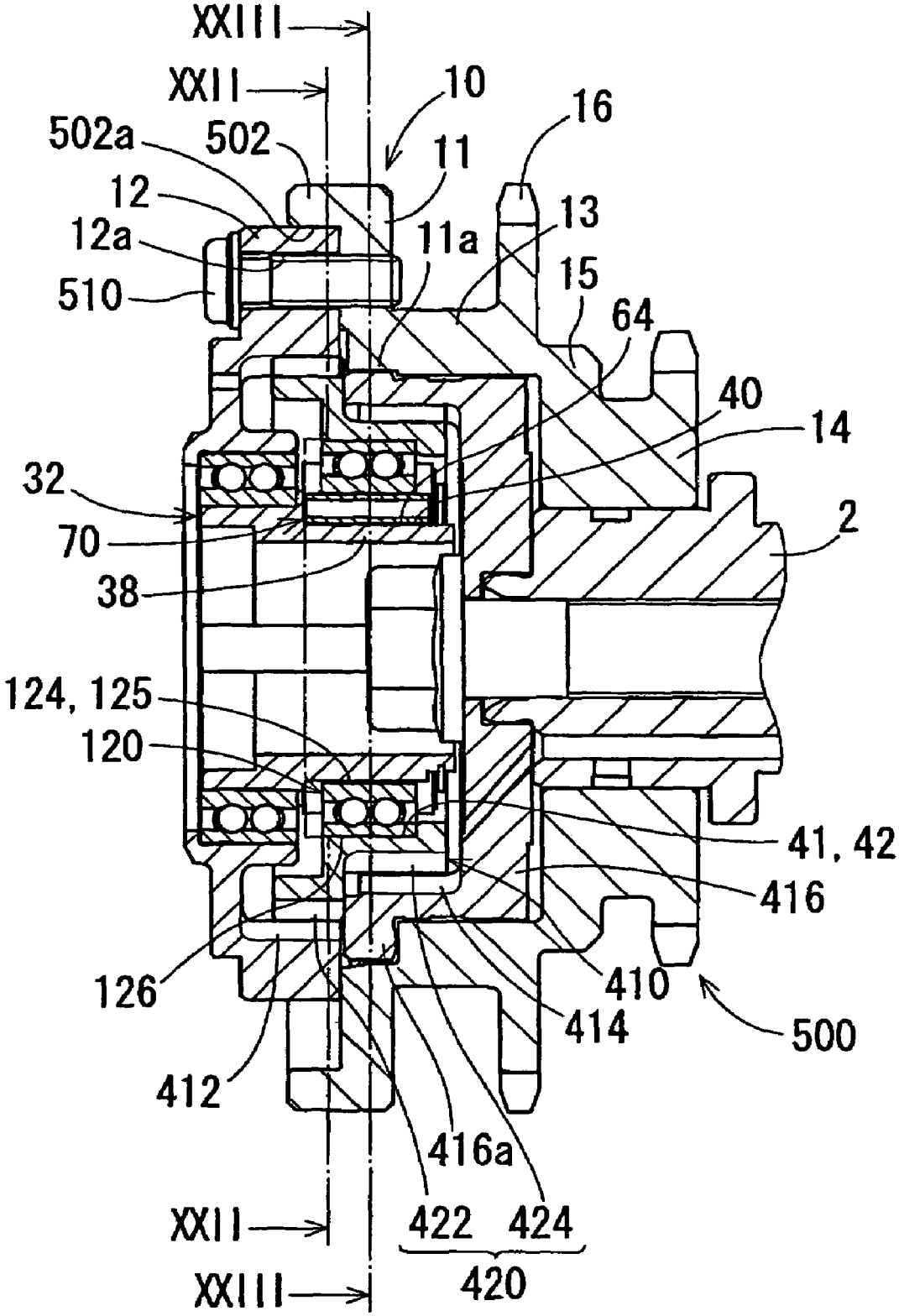
FIG. 24 is a cross section taken on line XXIV-XXIV in FIG. 23, showing a valve timing controller in a seventh embodiment of the present invention.

As shown in FIGS. 22 and 24, a seventh embodiment of the present invention is a modification of the sixth embodiment. In FIG. 24, the control unit 20 is omitted. A valve timing controller 500 in the seventh embodiment adjusts valve timing of an intake valve.

In the valve timing controller 500, three stoppers 11*a*, 11*b* and 11*c* are formed at the inner peripheral side of the large diameter portion 13 of the sprocket 11 by equal angular intervals to project in the radial inside toward the driven-side rotational element 416. In addition, three projections 416*a*, 416*b* and 416*c* are formed at the outer peripheral side of the driven-side rotational element 416 by equal angular intervals to project in the radial outer side. The projection 416*a* is received between the stopper 11*a* and the stopper 11*b*, the projection 416*b* is received between the stopper 11*b* and the stopper 11*c*, and the projection 416*c* is received between the stopper 11*c* and the stopper 11*a*. When the driven-side rotational element 416 is phase-controlled in the advance direction X and the retard direction Y to the sprocket 11 constituting the drive-side rotational element 10, the projection 416*a* contacts the stopper 11*a*, thereby defining the maximum retard position and the projection 416*a* contacts the stopper 11*b*, thereby defining the maximum advance position. The projections 416*b* and 416*c*, and the stopper 11*c* are formed as backup for defining the maximum retard position or the maximum advance position, for example, when the projection 416*a* or the stoppers 11*a* and 11*b* are damaged. Accordingly, when the projection 416*a* or the stoppers 11*a* and 11*b* are not damaged, the projections 416*b* and 416*c* do not contact the stoppers 11*a*, 11*b* and 11*c*.

As shown in FIG. 22, since also in the seventh embodiment, the spring member 70 is located at a position where the action line L is inclined to the eccentric direction line E within the angle region θ, the component of the elastic force F of the spring member 70 acting in the opposing direction to the outside force f changing in direction within the angle region ψ can cancel out the outside force f from the changing torque.

Here, when the driven-side rotational element 416 is phase-controlled to the drive-side rotational element 10 for the maximum retard position, the rotational torque of the motor shaft 24 is applied in the retard direction Y to contact the projection 416*a* with the stopper 11*a*. The power supply-control circuit 22 controls the power supply to the electric motor 21 when it is detected that the driven-side rotational element 416 has reached the maximum retard position, reducing the rotational torque of the motor shaft 24 acting in the retard direction Y. However, during a period from a point when the driven-side rotational element 416 reaches the maximum retard position to a point when the power supply control circuit 22 controls the power supply to the electric motor 21 and the rotational torque of the motor shaft 24 acting in the retard direction Y is reduced, the motor shaft 24 receives the rotational torque in the retard side due to inertia torque of the electric motor 21 in the retard direction Y. As a result, since the planetary carrier 32 receives further the rotational torque in the retard side in a state where the projection 416*a* contacts the stopper 11*a*, the projection 416*a* is pressed toward the stopper 11*a* in the retard side. Further, an average of the changing torque the camshaft 2 receives at the time of opening/closing the intake valve by the camshaft 2 acts in the retard side rather than in the advance side. Therefore, this changing torque possibly causes a speed of the projection 416*a* contacting the stopper 11*a* in the retard side to increase.

Thus even after the projection 416*a* contacts the stopper 11*a* and the maximum retard position is defined, when the rotational torque in the retard side is added to the motor shaft 24 or as the speed of the projection 416*a* contacting the stopper 11*a* in the retard side is increased by the changing torque when the projection 416*a* contacts the stopper 11*a*, the outer peripheral surface 40 of the planetary carrier 32 over-rotates to the bearing inner peripheral surface 125 of the bearing 120. As a result, the eccentric direction of the outer peripheral surface 40 of the planetary carrier 32 is shifted from the eccentric direction of the bearing inner peripheral surface 125 of the bearing 120. As a result, a deflection is generated in the slide clearance between the bearing inner peripheral surface 125 and the outer peripheral surface 40 of the planetary carrier 32, thereby possibly causing the bearing inner peripheral surface 125 to cut into the outer peripheral surface 40 of the planetary carrier 32 and vice versa. On the other hand, if the rotational speed of the motor shaft 24 controlling the phase to the maximum retard position is reduced, it is possible to prevent the cutting, but the responsiveness of the phase control deteriorates.

Figure 23:
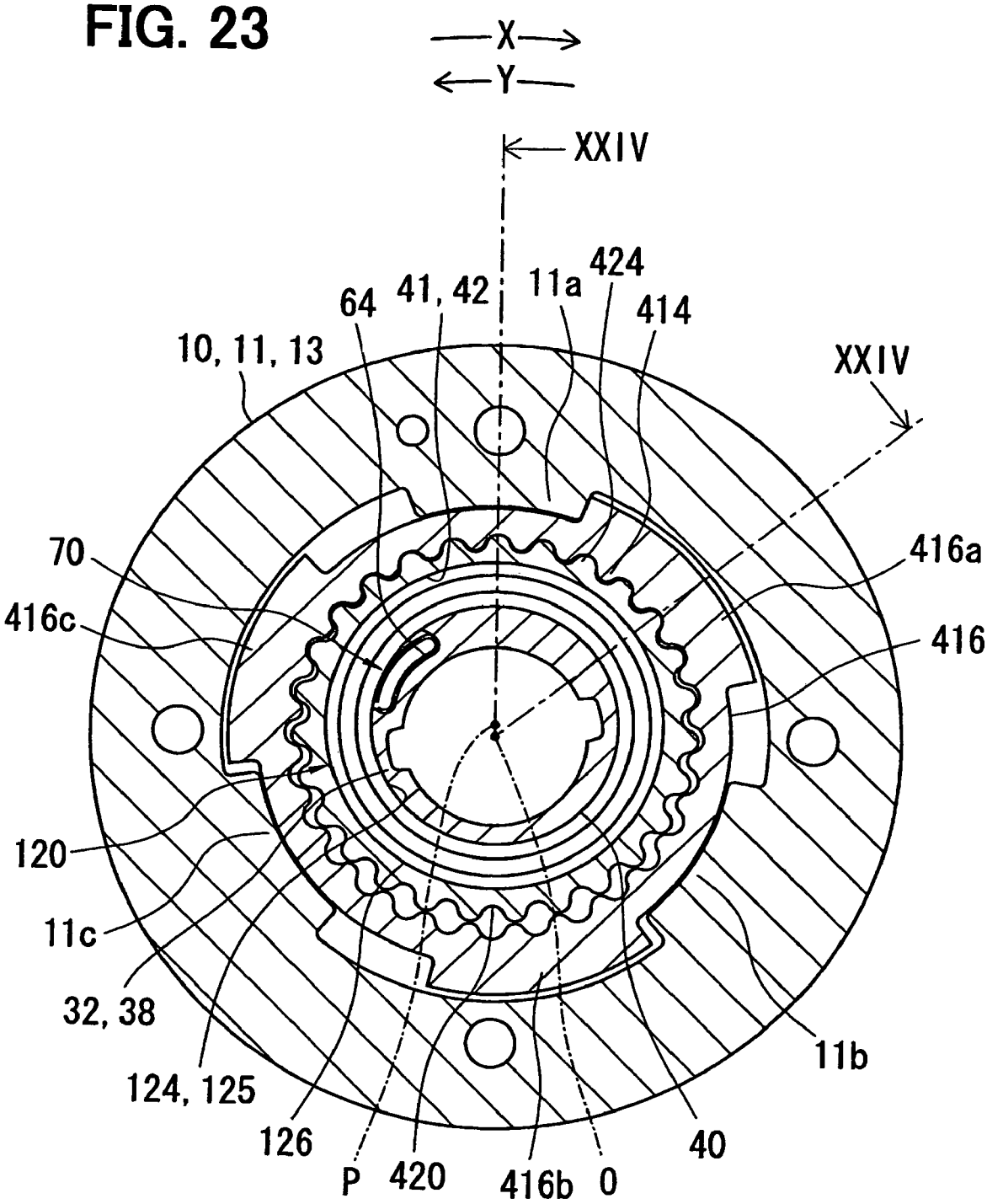
FIG. 23 is a cross section taken on line XXIII-XXIII in FIG. 24.
Figure 25:
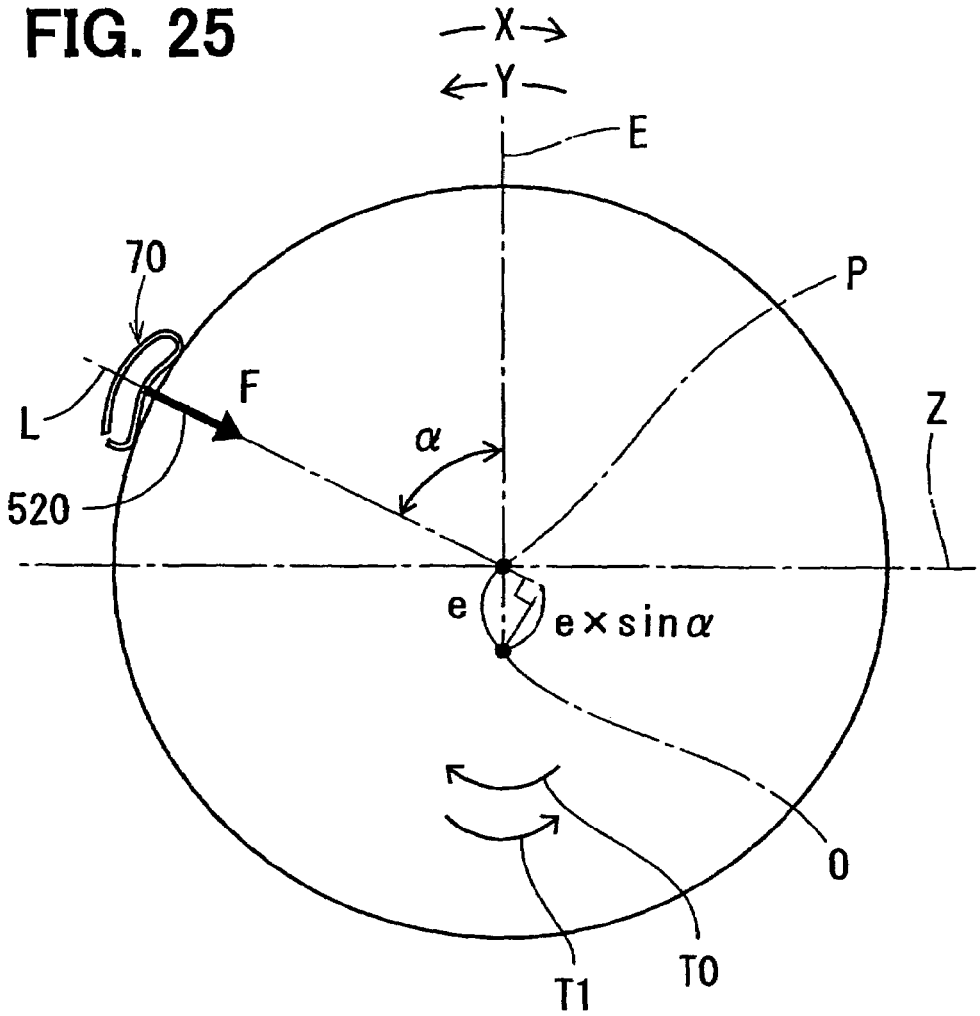
FIG. 25 is an explanatory diagram for rotational torque T0 applied to a planetary carrier from a spring member.

Therefore, as shown in FIGS. 22 and 23, in the seventh embodiment, the spring member 70 is arranged in the side of the retard direction Y of the planetary carrier 32 to the drive-side rotational element 10 from the eccentric direction line E. As shown in FIG. 25, the action line L of the elastic force F of the spring member 70 passes through an eccentric central line P. The elastic force F of the spring member 70 acts on the planetary carrier 32 in the direction shown in an arrow 520. Accordingly, the planetary carrier 32 is subject to the rotational torque T0 in the advance direction X from the elastic force F of the spring member 70. When a distance between the rotational central line O and the eccentric central line P, that is, an eccentric distance is e and the location angle where the spring member 70 is arranged in the side of the retard direction Y of the planetary carrier 32 to the drive-side rotational element 10 from the eccentric direction line E is α, the rotational torque T0 is expressed in the following formula (1).

$$T0=F\times e\times\sin\alpha \quad (1)$$

From the formula (1), $$T0/(F\times e)=\sin\alpha \quad (2)$$

Figure 26:
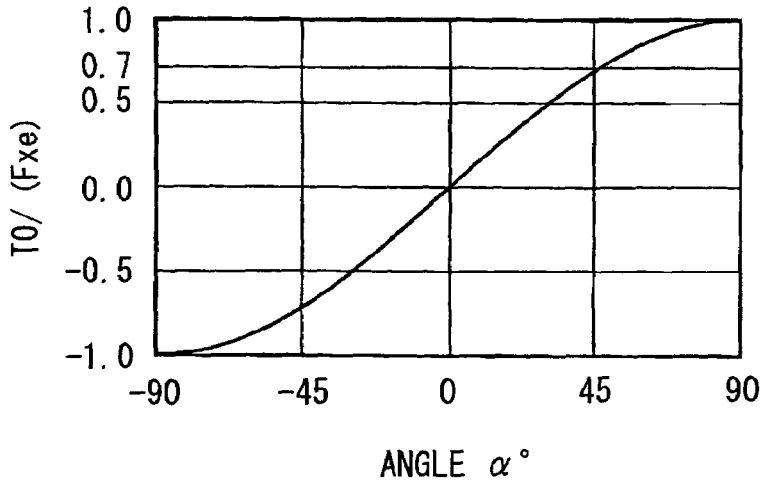
FIG. 26 is a characteristic graph showing a relation between a location angle of a spring member and rotational torque applied to a planetary carrier.

In the formula (2), e is constant and therefore, the rotational torque T0 acting on the carrier 32 in the advance direction X from the elastic force F changes with the location angle α. FIG. 26 shows a change of T0/(F×e) when α is changed. In FIG. 26, when T0/(F×e) is a positive, the rotational torque T0 acts in the advance direction X and when T0/(F×e) is a negative, the rotational torque T0 acts in the retard direction Y. Since T0/(F×e)=sin α, when α=90°, T0/(F×e), that is, T0 becomes the maximum.

Since in the seventh embodiment, the spring member 70 is thus arranged in the side of the retard direction Y of the planetary carrier 32 to the drive-side rotational element 10 from the eccentric direction line E, when the projection 416*a* contacts the stopper 11*a* at the time of the maximum retard controlling, the planetary carrier 32 is subject to the rotational torque T0 in the advance direction X in the opposing direction from the elastic force F of the spring member 70 to the inertia torque T1 of the electric motor 21 acting in the retard direction Y. Thereby, after the projection 416*a* contacts the stopper 11*a*, the rotational torque which the planetary carrier 32 receives in the retard side is reduced. Therefore, it is prevented that the cutting between the bearing inner peripheral surface 125 and the outer peripheral surface 40 of the planetary carrier 32 is generated.

The three-point support of the planetary gear 420 is realized by the elastic force F of the spring member 70 by canceling out the outside force f from the changing torque and at the same time, generation of the cutting between the bearing inner peripheral surface 125 and the outer peripheral surface 40 of the planetary carrier 32 by applying the rotational torque to the planetary carrier 32 in the advance direction X by the elastic force F of the spring member 70 is prevented. Therefore, the spring member 70 is required to be located in the retard side of the eccentric direction line E. In addition, for securing the rotational torque T0 applied to the planetary carrier 32 in the advance direction X by the elastic force F of the spring member 70 and preventing the bearing inner peripheral surface 125 from cutting into the outer peripheral surface 40 of the planetary carrier 32 and vice versa, it is preferable that the location angle $\alpha$ for locating the spring member 70 in the retard side to the eccentric direction line E is $45° \leqq \alpha \leqq 90°$. In consideration of the balance with cancellation of the outside force f from the changing torque by the elastic force F of the spring member 70, it is assumed that it is optimal to set the location angle $\alpha$ of the spring member 70 as approximately 45°.

In the seventh embodiment, as shown in FIG. 24, a circular projection 502 extending toward the cover gear 12 in the axial direction is formed at the outer peripheral edge portion of the large diameter portion 13 of the sprocket 11 facing the cover gear 12 in the axial direction. In addition, as shown in FIGS. 22 and 24, the cover gear 12 is press-fitted into an inner peripheral face 502*a* of the projection 502. The sprocket 11 and the cover gear 12 are jointed by a bolt 510, which is inserted into an insert bore 12*a* of the cover gear 12 and is a joint member threaded into the sprocket 11.

Figure 27:
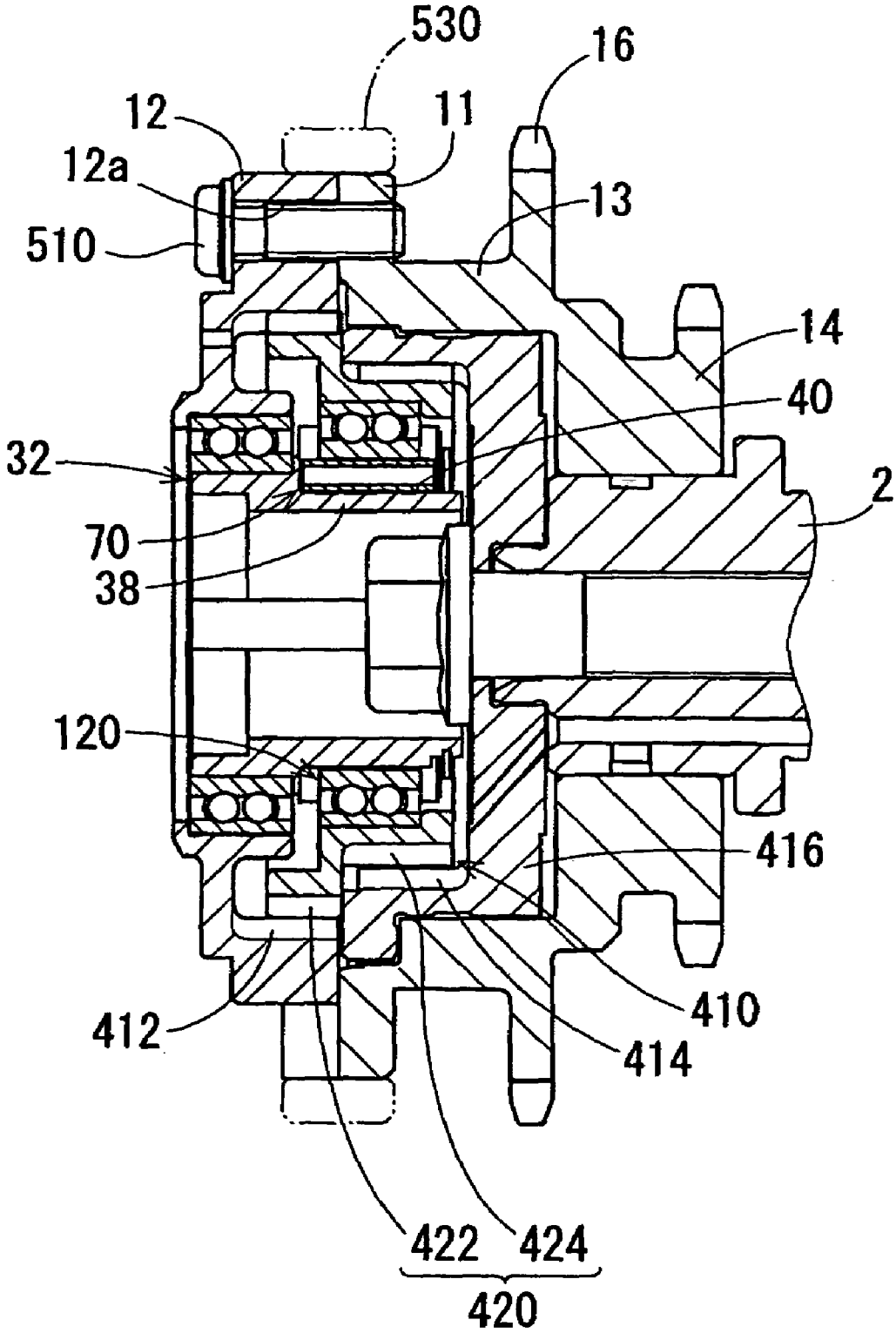
FIG. 27 RELATED ART
FIG. 27 is a cross section showing a comparison example to the seventh embodiment.

Since the cover gear 12 is thus press-fitted into the inner peripheral face 502*a* of the projection 502 of the sprocket 11, it is easy to position the sprocket 11 and the cover gear 12 in the radial direction on assembly. In contrast, foe example, as shown in FIG. 27, in the case of absence of the projection 502 in the sprocket 11, since it is required to locate the sprocket 11 and the cover gear 12 inside a circular tool 530 for radical positioning, the assembly job is complicated.

In addition, a force by which the cover gear 12 is shifted in the rotational and radial directions in relation to the sprocket 11 is possibly applied during operating of the valve timing controller 500. For example, as described above, even after the projection 416*a* contacts the stopper 11*a* and the maximum retard position is defined, when the outer peripheral surface 40 of the planetary carrier 32 over-rotates to the bearing inner peripheral surface 125 of the bearing 120, the eccentric direction of the outer peripheral surface 40 of the planetary carrier 32 is shifted from the eccentric direction of the bearing inner peripheral surface 125 of the bearing 120. The shift in the eccentric direction is added through the planetary gear 420 to the cover gear 12 as the force in the rotational and radial directions. That is, this shift acts as the force for shifting the cover gear 12 in the rotational and radial directions in relation to the sprocket 11. This shift force, in a comparison example shown in FIG. 27, possibly shifts the cover gear 12 in the rotational and radial directions in relation to the sprocket 11 by a clearance amount between the insert bore 12*a* of the bolt 510 formed in the cover gear 12 and the bolt 510.

However, since in the seventh embodiment, the cover gear 12 is press-fitted into the inner peripheral face 502*a* of the projection 502 of the sprocket 11, even if the above shift force is added to the cover gear 12, the cover gear 12 is limited in motion in the radial direction in relation to the sprocket 11, thus not being shifted in the radial direction. In addition, the press-fitting force due to the cover gear 12 press-fitted into the projection 502 creates a large friction force between the inner peripheral face 502*a* of the projection 502 and the outer peripheral face of the cover gear 12. Therefore, the shift of the cover gear 12 in the radial direction in relation to the sprocket 11 is prevented.

Eighth Embodiment and Ninth Embodiment

Figure 28:
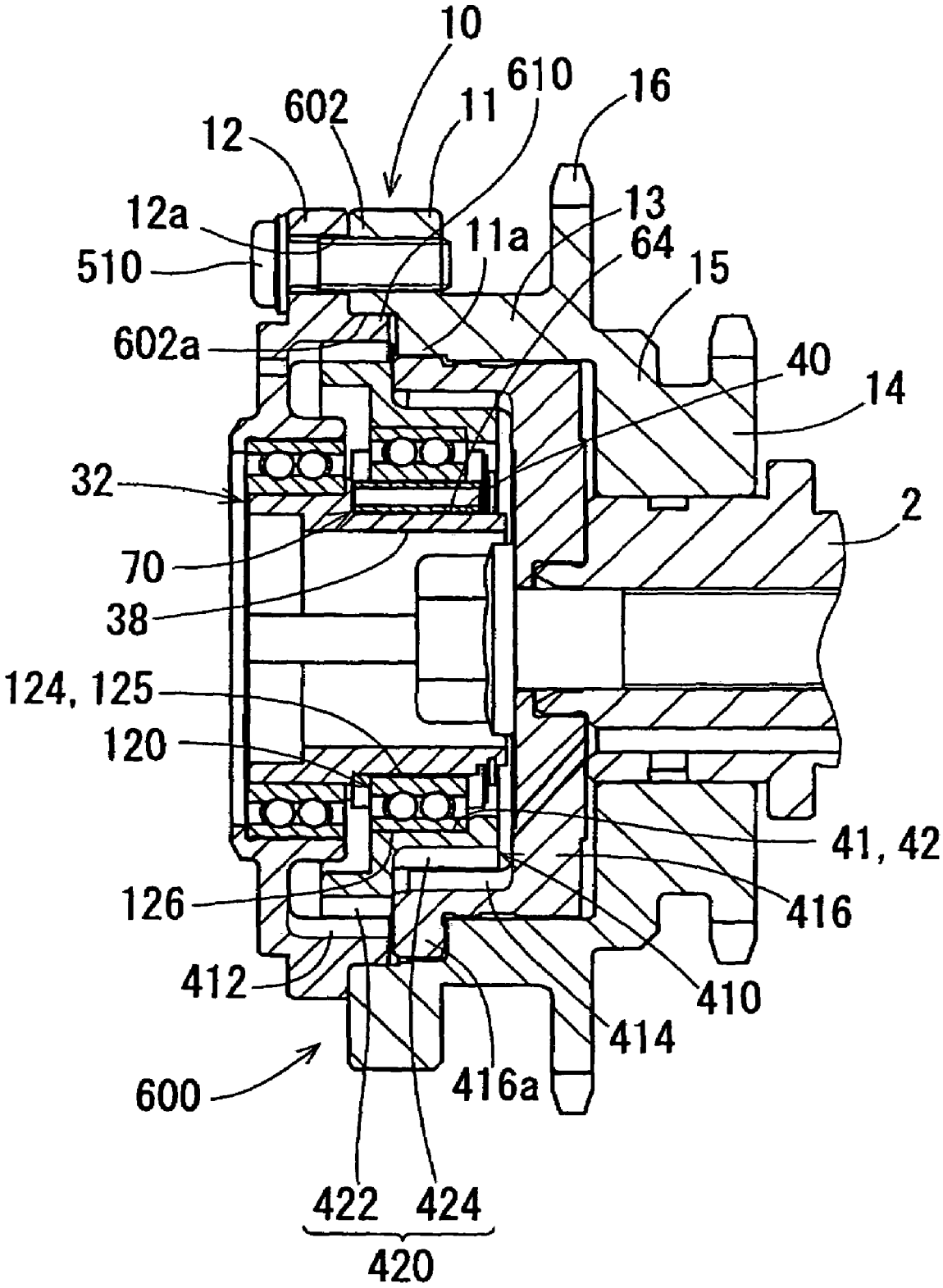
FIG. 28 is a cross section showing a valve timing controller in an eighth embodiment of the present invention.
Figure 29:
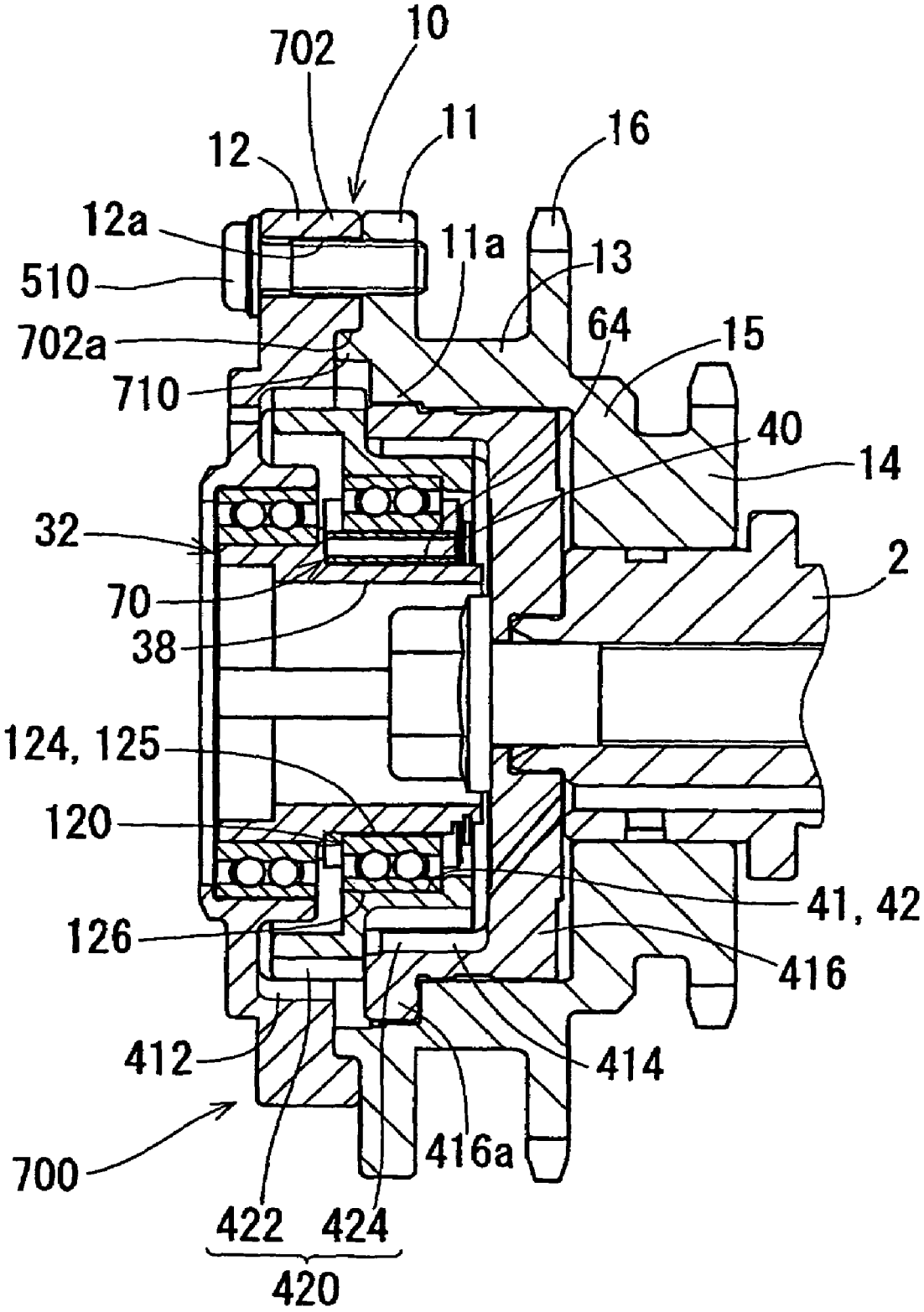
FIG. 29 is a cross section showing a valve timing controller in a ninth embodiment of the present invention.

FIG. 28 shows an eighth embodiment of the present invention. FIG. 29 shows a ninth embodiment of the present invention. Each of the eighth and ninth embodiments of the present invention is a modification of the seventh embodiment. Valve timing controllers 600 and 700 in the eighth and ninth embodiments adjust valve timing of an intake valve.

In the valve timing controller 600 in the eighth embodiment shown in FIG. 28, a circular projection 602 extending toward the cover gear 12 in the axial direction is formed at the outer peripheral edge portion of the large diameter portion 13 of the sprocket 11 facing the cover gear 12 in the axial direction. A circular inner peripheral projection 610 axially projecting toward the sprocket 11 is formed at the cover gear 12 in the inner peripheral side of the insert bore 12*a* for inserting the bolt 510. In addition, an inner peripheral projection 610 is press-fitted into the inner peripheral face 602*a* of the projection 602.

Accordingly, in the same way as in the seventh embodiment, it is easy to position the sprocket 11 and the cover gear 12 in the radial direction. Further, the rotational and radial shifts of the cover gear 12 in relation to the sprocket 11 are prevented.

In the valve timing controller 700 in the ninth embodiment shown in FIG. 29, a circular projection 702 extending toward the sprocket 11 in the axial direction is formed at the outer peripheral edge portion of the cover gear 12 facing the sprocket 11 in the axial direction. A circular inner peripheral projection 710 axially projecting toward the cover gear 12 is formed at the sprocket 11 in the inner peripheral side of the location where the bolt 510 is threaded. In addition, an inner peripheral projection 710 is press-fitted into the inner peripheral face 702*a* of the projection 702.

Accordingly, in the ninth embodiment, in the same way as in the seventh and eighth embodiments, it is easy to position the sprocket 11 and the cover gear 12 in the radial direction. Further, the rotational and radial shifts of the cover gear 12 in relation to the sprocket 11 are prevented.

In addition, in each of the eighth and ninth embodiments, in the same way as the seventh embodiment, since the spring member 70 is arranged in the side of the retard direction Y of the planetary carrier 32 to the drive-side rotational element 10 from the eccentric direction line E, when the projection 416*a* contacts the stopper 11*a* at the time of the maximum retard controlling, the generation of the cutting between the bearing inner peripheral surface 125 and the outer peripheral surface 40 of the planetary carrier 32 is prevented.

Tenth Embodiment

Figure 30:
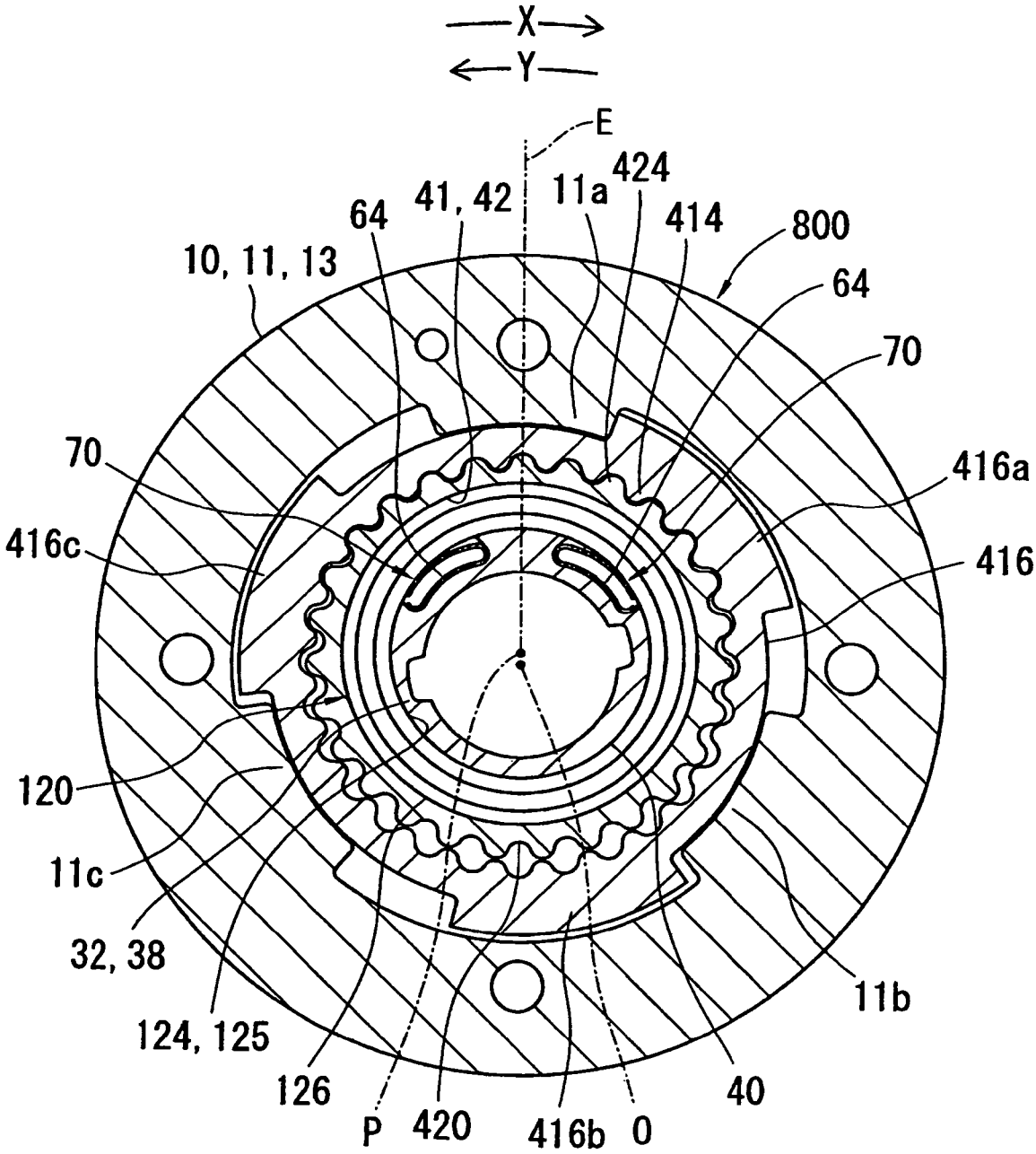
FIG. 30 is a cross section showing a valve timing controller in a tenth embodiment of the present invention in the same cross section position as FIG. 23.
Figure 31:
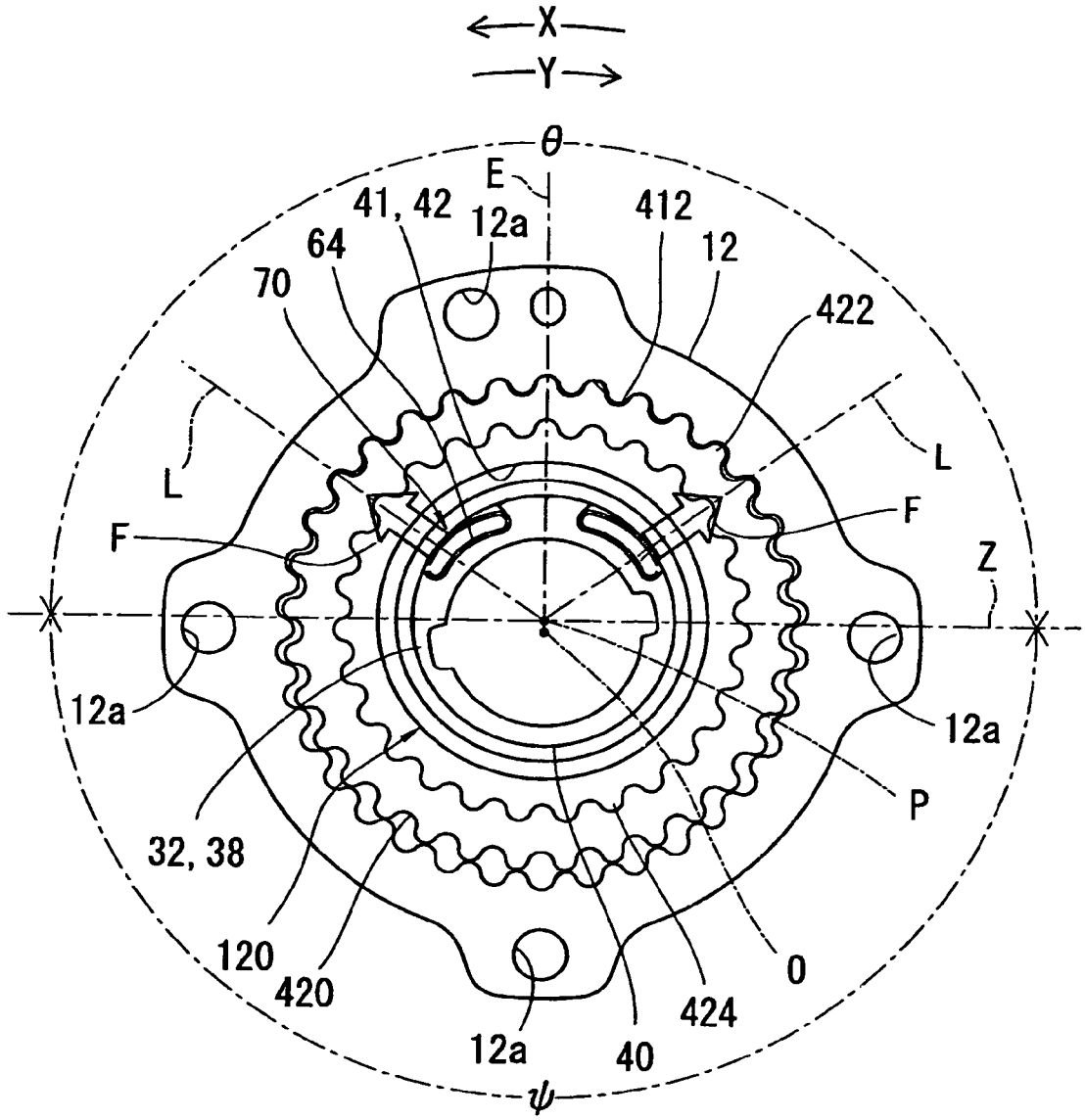
FIG. 31 is a diagram showing a planetary gear and a cover gear in the tenth embodiment without a driven-side rotational element, viewed from the side of a camshaft.
Figure 32:
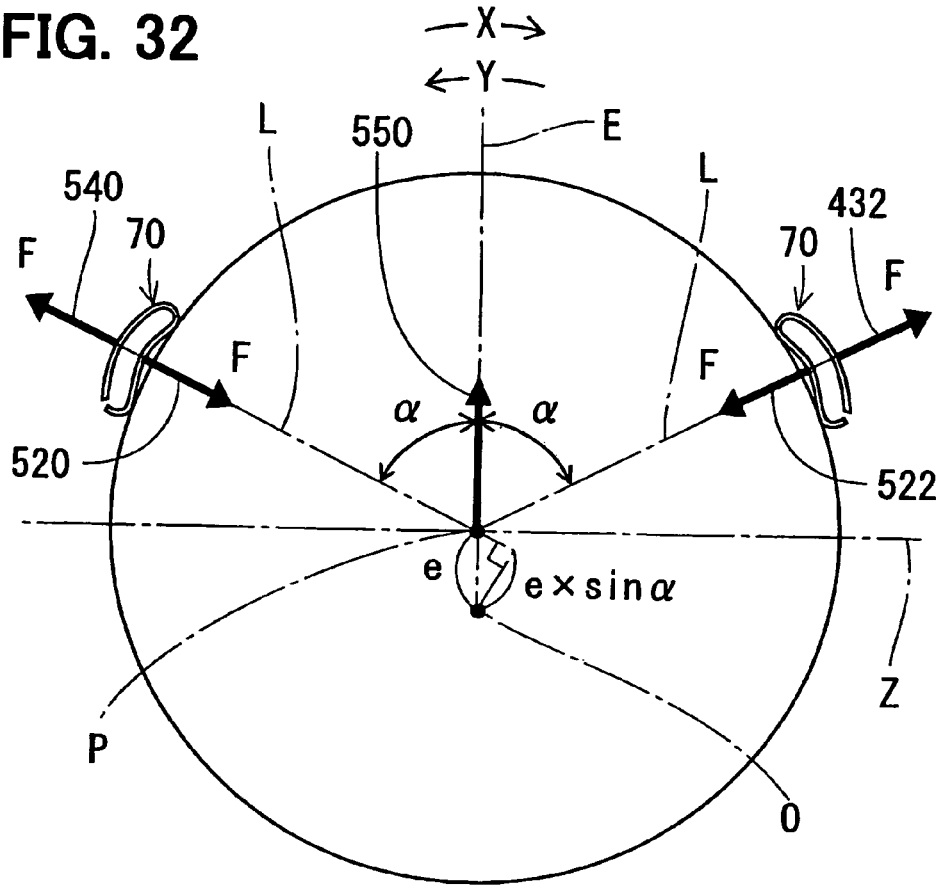
FIG. 32 is an explanatory diagram of forces applied to a planetary carrier and a planetary gear from a spring member.

FIGS. 30 to 32 show a tenth embodiment of the present invention. A valve timing controller 800 in the tenth embodiment adjusts valve timing of an intake valve. In the tenth embodiment, the spring member 70 is located in each of the retard side and the advance side as both sides in the circumferential direction placing the eccentric direction line E therebetween as shown in FIGS. 30 to 32. Since the structure except for this arrangement is substantially the same as in the seventh embodiment, components identical to those in the seventh embodiment are referred to as identical numerals. FIG. 31 is a diagram showing a planetary gear 420 and the cover gear 12 in the tenth embodiment, which is viewed from the side of the camshaft 2 in a state where the driven-side rotational element 416 is removed in FIG. 24 in the seventh embodiment. Since the planetary gear 420 and the cover gear 12 are viewed from the side of the camshaft 2 in FIG. 31, an arrow X showing the advance direction and an arrow Y showing the retard direction are in direction in reverse to those in FIG. 30.

As shown in FIGS. 30 to 32, in the tenth embodiment, the spring member 70 is provided in each angle region θ of the advance side and the retard side on the basis of the eccentric direction line E. The angle region θ is a region positioned in an eccentric side of the eccentric outer peripheral surface 40 from an orthogonal line Z orthogonal to the eccentric direction line E on the eccentric central line P of the eccentric outer peripheral surface 40.

Figure 33:
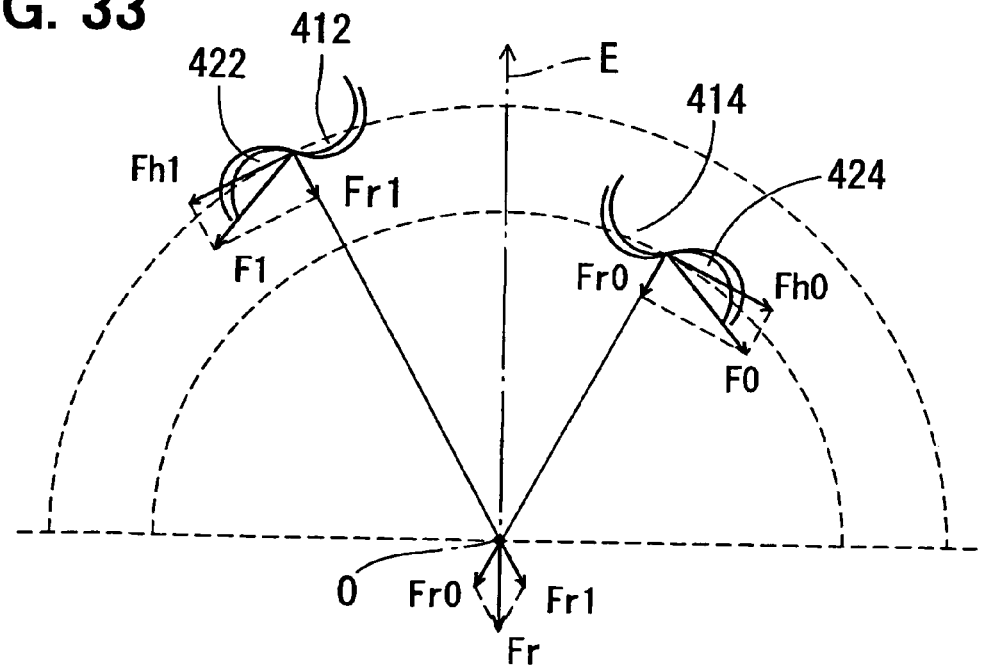
FIG. 33 is an explanatory diagram of forces which a planetary gear receives from changing torque.

In the tenth embodiment, in the same way as in the sixth to ninth embodiments, the external gear portions 422 and 424 are formed at different positions in the axial direction of the two-step, cylindrical planetary gear 420 and constitute a dual type differential gear mechanism engaging to the internal gear portions 412 and 414. When the driven-side rotational element 416 as the third gear element receives changing torque from the camshaft 2 in such a differential gear mechanism, the external gear portion 424 of the planetary gear 420, as shown in FIG. 33, receives a force F0 in an arrow direction from the internal gear portion 414 in the engagement location with the internal gear portion 414 of the driven-side rotational element 416. This force F0 is divided into force Fh 0 in a tangential direction and radial force Fr 0 toward the rotational central line O at a radial inside.

When the changing torque transmitted from the driven-side rotational element 416 to the planetary gear 420 is transmitted from the planetary gear 420 to the cover gear 12 having the internal gear portion 412, the external gear portion 422 of the planetary gear 420 receives a force F1 in an arrow direction from the internal gear portion 414 in the engagement location with the internal gear portion 412 of the cover gear 12. This force F1 is divided into force Fh 1 in a tangential direction and radial force Fr 1 toward the rotational central line O at a radial inside. As shown in FIG. 33, the torque equal to the changing torque is generated in each of the force Fh 0 and the force Fh 1 of the tangential direction in the opposing directions with each other and is canceled out. On the other hand, a sum of radial forces Fr 0 and Fr 1 toward the rotational central line O at a radial inside is equal to a radial force Fr toward the radial inside substantially along the eccentric direction line E.

Since, as described above, in the tenth embodiment, the spring members 70 are located at both sides in the circumferential direction on the basis of the eccentric direction line E, a sum of the elastic forces F applied to the planetary gear 420 in the directions of arrows 540 and 542 by both of the spring members 70 is, as shown in FIG. 32, oriented toward the radial outside along the eccentric direction line E as shown in an arrow 550. That is, when the driven-side rotational element 416 receives the changing torque and the changing torque is transmitted to the planetary gear 420 and the cover gear 12, a sum force of the elastic forces which the planetary gear 420 receives from two spring members 70, as shown in an arrow 550, act in the direction opposed to a sum Fr of forces which the planetary gear 420 receives from the driven-side rotational element 416 and the cover gear 12. Accordingly, even if the changing torque which the driven-side rotational element 416 receives from the camshaft 2 is applied to the planetary gear 420, the planetary gear 420 is unlikely to rattle to the driven-side rotational element 416 and the cover gear 12. Therefore, the tooth hit between the driven-side rotational element 416 and the cover gear 12, and the planetary gear 420 due to the changing torque is avoided, preventing generation of the abnormal noises.

In the tenth embodiment, the planetary gear 420 is supported by at least three locations, i.e., the engagement location with the cover gear 12 or the driven-side rotational element 416, the intersection location between the action line L of one spring member 70 and the gear peripheral surface 42, and the intersection location between the action line L of the other spring member 70 and the gear peripheral surface 42. Since the planetary gear 420 is supported in such support state, even if the changing torque which the driven-side rotational element 416 receives from the camshaft 2 is applied to the planetary gear 420, the planetary gear 420 is unlikely to rattle to the driven-side rotational element 416 and the cover gear 12. Therefore, the tooth hit between the driven-side rotational element 416 and the cover gear 12, and the planetary gear 420 due to the changing torque is avoided, preventing generation of the abnormal noises.

In the tenth embodiment, the spring member 70 is located in the planetary carrier 32 in the side of the advance direction X and in the side of the retard direction Y to the drive-side rotational element 10 to the eccentric direction line E. As shown in FIG. 32, the action lines L of the elastic forces F of the two spring members 70 pass through the eccentric direction line P. In addition, the elastic forces F of the two spring members 70 act on the planetary carrier 32 in the directions shown in arrows 520 and 522. Accordingly, the planetary carrier 32 is subject to the rotational torque in the advance direction X and in the retard direction Y from the elastic force F of the spring member 70 around the rotational central line O.

Here, when, during the maximum retard controlling, the projection 416*a* shown in FIG. 30 contacts the stopper 11*a* and the rotational torque in the retard side is further added to the planetary carrier 32, the clearance between the outer peripheral surface 40 of the planetary carrier 32 and the bearing inner peripheral surface 125 is narrower in the retard side than in the advance side on the basis of the eccentric direction line E. With this, the rotational torque in the advance side applied to the planetary carrier 32 by the spring member 70 located in the retard side is larger than the rotational torque in the retard side applied to the planetary carrier 32 by the spring member 70 located in the advance side. As a result, when the projection 416*a* contacts the stopper 11*a* in the retard side, since the rotational torque added to the planetary carrier 32 in the retard side toward the stopper 11*a* is further smaller, the cutting between the outer peripheral surface 40 of the planetary carrier 32 and the bearing inner peripheral surface 125 can be prevented.

Here, when, during the maximum advance controlling, the projection 416*a* contacts the stopper 11*b* and the rotational torque in the advance side is further added to the planetary carrier 32, the clearance between the outer peripheral surface 40 of the planetary carrier 32 and the bearing inner peripheral surface 125 is narrower in the advance side than in the retard side on the basis of the eccentric direction line E. With this, the rotational torque in the retard side applied to the planetary carrier 32 by the spring member 70 located in the advance side is larger than the rotational torque in the advance side applied to the planetary carrier 32 by the spring member 70 located in the retard side. As a result, when the projection 416*a* contacts the stopper 11*b* in the advance side, since the rotational torque added to the planetary carrier 32 in the advance side upward the stopper 11*b* is further smaller, the cutting between the outer peripheral surface 40 of the planetary carrier 32 and the bearing inner peripheral surface 125 can be prevented.

In addition, from a point of view that the rotational torque applied to the planetary carrier 32 in the advance direction X and in the retard direction Y by the elastic force F of the spring member 70 is secured and generation of the cutting between the bearing inner peripheral surface 125 and the outer peripheral surface 40 of the planetary carrier 32 is prevented, it is preferable that the location angle $\alpha$ shown in FIG. 32 for locating the spring member 70 in the retard side and in the advance side to the eccentric direction line E is $45° \leqq \alpha \leqq 90°$. In consideration of the balance with cancellation of the outside force f from the changing torque by the elastic force F of the spring member 70, it is assumed that it is optimal to set the location angle $\alpha$ of the spring member 70 as approximately 45°.

A plurality of embodiments of the present invention have been described so far, but the present invention is not construed as limited to those embodiments and can be applied to various embodiments within the spirit thereof.

For example, in the first to fifth embodiments, the spring member 70 and the leaf spring 210 may be located so that the direction of the elastic force F is in reverse to that of the outside force f when the changing torque becomes at the maximum negative torque T. In addition, in the first and fifth embodiments, the number of the engagement bore 48 and the engagement projection 49 may be changed as needed, but since the shift region of the direction of the outside force f which the planetary gear 33 and 330 receives changes with such number, it is preferable to define the direction of the elastic force F in accordance with it.

In the first to fifth embodiments, the transmission rotational element 34 may be connected to the driven-side rotational element 18 or be formed integrally with the driven-side rotational element 18 without provision of the link mechanism 50, 340 and the guide rotational portion 54. In the first to fourth embodiments, the link mechanism 340 in the fifth embodiment may be provided in place of the link mechanism 50 and in the fifth embodiment, the link mechanism 50 in the first embodiment may be provided in place of the link mechanism 340. In the case of no provision of the link mechanism 50, 340 or in the case of using an alternative of the link mechanism 50, 340, since the shift region of the direction of the outside force f which the planetary gear 33, 330 receives changes, it is preferable to set the direction of the elastic force F in accordance with it.

In the first to sixth embodiments, as long as the action line L is inclined within the angle region $\theta$ to the eccentric direction line E, the spring member 70 or a part of the leaf spring 210 may be located on the eccentric direction line E. In addition, in the first to ninth embodiments, as long as the action line L is inclined within the angle region $\theta$ to the eccentric direction line E, a plurality of the spring members 70 or a plurality of sets of the leaf springs 210 may be located in parallel in the axial or circumferential direction of the planetary carrier 32. Further, in the sixth embodiment, the spring member 70 may be located only in the inner peripheral side of the drive-side external gear portion 422 or only in the inner peripheral side of the driven-side external gear portion 424.

In the first to third embodiments and in the fifth to tenth embodiments, the bending portion 75 may not be provided in the inner-peripheral-side contact portion 72 of the spring member 70 and the clearance between the spring member 70 and the receiving portion 64 or the washer member 170 may not be provided in the reference circumferential direction. In addition, in the first to third embodiments and in the fifth to tenth embodiments, the configuration except the configurations explained in the first and third embodiments may be adopted with respect to the inner bottom surface 66 of the receiving portion 64, the outer peripheral surfaces 171 and 172 of the washer member 170 and the outer-peripheral-side contact portions 72 and 73 of the spring member 70. Further, in the first to third embodiments and in the fifth to tenth embodiments, the end portions more remote from the eccentric direction line E out of both end portions in the reference circumferential direction of the respective contact portions 72 and 73 may be connected by the connecting portion 74 and the end portions nearer to the eccentric direction line E may be opened.

In the fourth embodiment, the clearance between both sides in the reference circumferential direction of each spring plate 211, 212 and the washer member 170 may not be formed or the spring plate 211 at the innermost periphery may directly contact the inner bottom surface 66 of the receiving portion 64. However, in the latter case, it is preferable that the curvature radius $R_f$ of the spring plate 211 is set to be smaller than the curvature radius $R_b$ of the inner bottom surface 66 of the receiving portion 64. In the fourth embodiment, the configuration except the configurations explained in the third and fourth embodiments may be adopted with respect to the inner bottom surface 66 of the receiving portion 64, the outer peripheral surfaces 171 and 172 of the washer member 170 and the spring plates 211 and 212. Furthermore, in the fourth embodiment, the leaf springs 210 may be composed of three or more spring plates.

Figure 34:
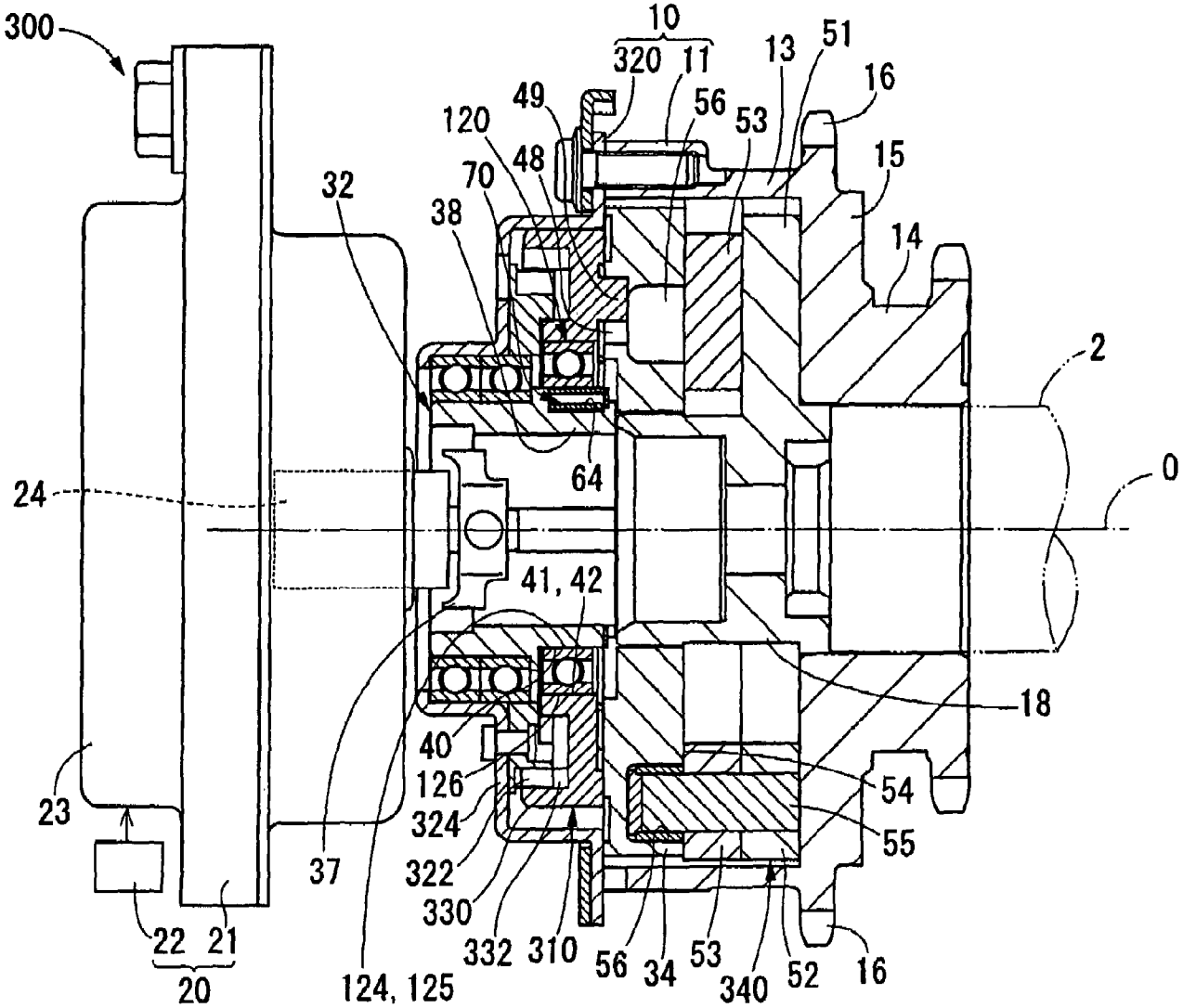
FIG. 34 is a cross section corresponding to FIG. 2, showing a modification example of a valve timing controller shown in FIG. 14.

In the first and tenth embodiments, the rotational element 10 may rotate together with the camshaft 2 and the rotational elements 18 and 416 may rotate together with the crankshaft. In the third to fifth embodiments, the planetary bearing 120 may be added between the gear inner peripheral surface 42 of the planetary gear 33, 330 and the eccentric outer peripheral surface 40 of the eccentric cam portion 38, for example, as shown in FIG. 34 (this figure is an example of the fifth embodiment) similarly to the second embodiment. In contrast, in the sixth embodiment, the planetary bearing 120 may be eliminated similarly to the first embodiment, and the gear inner peripheral surface 42 of the planetary gear 420 may be directly pressed by the spring member 70. In addition, in the fifth and sixth embodiments, the washer member 170 may be added between the receiving portion 64 of the eccentric cam portion 38 and the spring member 70 similarly to the third embodiment, or the leaf spring 210 in the fourth embodiment may be provided in place of the spring member 70.

Furthermore, as "pressing element", a known element generating an elastic force, such as the spring member 70, the leaf spring 210 and besides, a single plate spring, a coil spring, a torsion spring, a plunger or the like may be used. In addition, as "torque generating portion", besides the above-mentioned electric motor 21, there may be used a device including a brake member rotating by transmission of the drive torque of the crankshaft and a solenoid magnetically sucking the brake member for generating a braking torque produced in the brake member magnetically sucked to the solenoid as "rotational torque" or a hydraulic motor. In addition, the present invention may be applied to the above-mentioned valve timing controllers 1, 100, 150, 200, 300, 400, 500, 600, 700, and 800 for adjusting valve timing of the intake valve, and besides, may be applied to a valve timing controller for adjusting valve timing of an exhaust valve or a valve timing controller for adjusting valve timing of both of an intake valve and an exhaust valve.

In the valve timing controller in the seventh to ninth embodiments, in order to prevent generation of the cutting between the bearing inner peripheral surface 125 and the outer peripheral surface 40 of the planetary carrier 32 when the projection 416*a* contacts the stopper 11*b* for defining the maximum advance position, the spring member 70 may be located in the side of the advance direction X in place of locating the spring member 70 in the side of the retard direction Y of the planetary carrier 32 to the drive-side rotational element 10 from the eccentric direction line E. In this case, when the projection 416*a* contacts the stopper 11*b* during the maximum advance controlling, the planetary carrier 32 receives the rotational torque T0 in the retard direction Y in the opposing direction from the elastic force F of the spring member 70 to an inertia torque T1 of the electric motor 21 acting in the advance direction X. Thus, the structure for locating the spring member 70 in the side of the advance direction X of the planetary carrier 32 to the drive-side rotational element 10 from the eccentric direction line E is suitable for a valve timing controller for an exhaust valve. This is because a valve timing controller for an exhaust valve possibly adopts the structure for urging the driven-side rotational element 416 toward an advance side by the load of a spring or the like to maintain the valve timing at the maximum advance against the changing torque during stop of the engine.

In the valve timing controller in the seventh to tenth embodiments, when the action line L of the elastic force F of the spring member 70 is shifted from the rotational central line O and the rotational torque in the retard side or in the advance side is added to the planetary carrier 32, the action line L is not required to pass through eccentric central line P.

In the valve timing controller in the seventh to tenth embodiments, one of the sprocket 11 and the cover gear 12 is not press-fitted into the other, but by loose fitting of both, the radial position shift of the cover gear 12 to the sprocket 11 may be prevented.

In the tenth embodiment, the spring member 70 is provided in each of the advance side and the retard side of both sides in the circumferential direction on the basis of the eccentric direction line E. However, if a plurality of spring members 70 are provided at different positions in the circumferential direction between the planetary carrier 32 and the bearing inner peripheral surface 125 in the eccentric side of the outer peripheral surface from the orthogonal line Z orthogonal to the eccentric central line P of the outer peripheral surface and to the eccentric direction line E, and the action line L of the elastic force of at least one spring member 70 is inclined to the eccentric direction line E in the circumferential direction of the outer peripheral surface 40, this spring member 70 and the other spring member 70 may be located at the same side of the retard side or the advance side to the eccentric direction line E or the other spring member 70 may be located on the eccentric direction line E.

In the tenth embodiment, a dual type differential gear mechanism where the planetary gear 420 is engaged with both of the cover gear 12 and the driven-side rotational element 416, the spring member 70 is located in each of the advance side and the retard side of both sides in the circumferential direction on the basis of the eccentric direction line E. However, a single type differential gear mechanism where the planetary gear 33 is, like the first embodiment, engaged only with the cover gear 12, a plurality of spring members 70 may be provided at different positions in the circumferential direction in the outer peripheral side of the planetary carrier 32 in the eccentric side of the outer peripheral surface 40 from the orthogonal line Z orthogonal to the eccentric central line P of the outer peripheral surface 40 and to the eccentric direction line E. The action line L of the elastic force of at least one spring member 70 may be inclined in the circumferential direction of the outer peripheral surface 40 to the eccentric direction line E.

While only the selected example embodiments have been chosen to illustrate the present invention, it will be apparent to those skilled in the art from this disclosure that various changes and modifications can be made therein without departing from the scope of the invention as defined in the appended claims. Furthermore, the foregoing description of the example embodiments according to the present invention is provided for illustration only, and not for the purpose of limiting the invention as defined by the appended claims and their equivalents.

What is claimed is:

1. A valve timing controller for an internal combustion engine which adjusts valve timing of at least one of an intake valve and an exhaust valve opened/closed by a camshaft on the basis of torque transmission from a crankshaft to the camshaft, comprising:

a first gear element rotating in association with a first shaft which corresponds to one of the crankshaft and the camshaft;

a planetary carrier including an outer peripheral surface eccentric to the first gear element;

a second gear element including a central bore rotatably engaging with the outer peripheral surface and forming a gear mechanism in an internal gear engagement with the first gear element, the second gear element performing a planetary motion while engaging with the first gear element by a relative rotation of the planetary carrier to the first gear element;

a conversion portion for converting the planetary motion of the second gear element into a rotational motion of a second shaft, which corresponds to the other of the crankshaft and the camshaft, to change a relative rotational phase between the crankshaft and the camshaft; and a pressing element provided between the planetary carrier and the central bore for pressing an inner peripheral surface of the central bore by an elastic force thereof, wherein an action line of the elastic force is inclined in a circumferential direction of the outer peripheral surface with respect to an eccentric direction line of the outer peripheral surface.

2. A valve timing controller according to claim 1, wherein:

the pressing element is located at a position deviating from the eccentric direction line.

3. A valve timing controller according to claim 1, wherein:

the action line intersects with the inner peripheral surface in an eccentric side of the outer peripheral surface from an orthogonal line orthogonal to the eccentric direction line on an eccentric central line of the outer peripheral surface.

4. A valve timing controller according to claim 1, wherein:

the elastic force acts on the inner peripheral surface in a direction opposing to an outside force acting on the second gear element by a torque transmitted from the second shaft to the conversion portion.

5. A valve timing controller according to claim 4, wherein:

the elastic force acts on the inner peripheral surface in a direction opposing to the outside force when the torque is maximized.

6. A valve timing controller according to claim 1, wherein:

the first gear element includes a drive-side rotational element rotating in association with the crankshaft and a driven-side rotational element rotating in a retard direction and in an advance direction relative to the drive-side rotational element in association with the camshaft, further comprising:

a stopper for contacting the driven-side rotational element with the drive-side rotational element in at least one of the retard side and the advance side to restrict a relative rotation of the driven-side rotational element, wherein:

the action line passes through a position deviating from a rotational center of the first gear element; and the elastic force of the pressing element applies rotational torque to the planetary carrier in a direction opposing to a retard direction or an advance direction where the driven-side rotational element contacts the stopper.

7. A valve timing controller according to claim 6, wherein:

the action line passes substantially through an eccentric center of the outer peripheral surface.

8. A valve timing controller according to claim 7, wherein:

the stopper restricts the relative rotation of the driven-side rotational element at a most retarded position; and the pressing element is located in a retard side of the planetary carrier to the drive-side rotational element from the eccentric direction line.

9. A valve timing controller according to claim 8, wherein:

the pressing element is located within a range of 45° to 90° with respect to the eccentric direction line in the retard direction of the planetary carrier relative to the drive-side rotational element.

10. A valve timing controller according to claim 7, wherein:

the stopper restricts the relative rotation of the driven-side rotational element at a most advanced position; and the pressing element is located in an advance side of the planetary carrier to the drive-side rotational element from the eccentric direction line.

11. A valve timing controller according to claim 10, wherein:

the pressing element is located within a range of 45° to 90° with respect to the eccentric direction line in the advance direction of the planetary carrier relative to the drive-side rotational element.

12. A valve timing controller according to claim 1, wherein:

an output end for outputting the rotational motion to the second shaft in the conversion portion is fixed to the second shaft.

13. A valve timing controller according to claim 1, wherein:

the planetary carrier includes a receiving portion for receiving the pressing element; and the pressing element projects through the outer peripheral surface from the receiving portion to contact the inner peripheral surface.

14. A valve timing controller according to claim 13, wherein:

the pressing element includes a deformation portion which is flexibly deformed due to being compressed between the receiving portion and the central bore.

15. A valve timing controller according to claim 13, wherein:

the receiving portion is opened to the outer peripheral surface in a position deviating from the eccentric direction line; and the pressing element projects through an opening of the receiving portion.

16. A valve timing controller according to claim 1, wherein:

the pressing element is formed of a spring member; and the pressing element includes an inner-peripheral-side contact portion contacting the planetary carrier and an outer-peripheral-side contact portion provided in an outer peripheral side of and spaced from the inner-peripheral-side contact portion for contacting the inner peripheral surface, wherein:

one end portions in the circumferential direction of the inner-peripheral-side contact portion and the outer-peripheral-side contact portion are connected; and the other end portions in the circumferential direction of the inner-peripheral-side contact portion and the outer-peripheral-side contact portion are opened.

17. A valve timing controller according to claim 16, wherein:

the planetary carrier includes a cylindrical contact surface which the inner-peripheral-side contact portion contacts; and the inner-peripheral-side contact portion is bent along the contact surface and has a cross section in an arc shape having a diameter smaller than that of the contact surface.

18. A valve timing controller according to claim 16, wherein:

the outer-peripheral-side contact portion is bent along the cylindrical inner peripheral surface and has a cross section in an arc shape having a diameter smaller than that of the inner peripheral surface.

19. A valve timing controller according to claim 18, wherein:

the connecting portion connects the end portions, which are closer to the eccentric direction line, of the inner-peripheral-side contact portion and the outer-peripheral-side contact portion.

20. A valve timing controller according to claim 16, wherein:

the planetary carrier includes a pair of opposing faces facing with each other by placing the pressing element between the opposing faces in the circumferential direction.

21. A valve timing controller according to claim 20, wherein:

the end portion of the inner-peripheral-side contact portion in an opposing side to the connecting portion is bent toward an outer peripheral side.

22. A valve timing controller according to claim 20, wherein:

a clearance is formed in the circumferential direction between the opposing face and the pressing element.

23. A valve timing controller according to claim 1, wherein:

the pressing element includes a leaf spring formed of a plurality of spring plates which are bent along the cylindrical inner peripheral surface.

24. A valve timing controller according to claim 23, wherein:

the planetary carrier includes a cylindrical contact surface which the spring plate at the innermost periphery contacts; and the spring plate at the innermost periphery has a cross section having an arc shape smaller in diameter than the contact surface.

25. A valve timing controller according to claim 23, wherein:

the spring plate at the outermost periphery has a cross section having an arc shape smaller in diameter than the inner peripheral surface.

26. A valve timing controller according to claim 1, further comprising:

a torque generating portion for generating rotational torque, wherein:

the planetary carrier rotates relatively to the first gear element by receiving the rotational torque.

27. A valve timing controller according to claim 26, wherein:

the torque generating portion includes an electric motor.

28. A valve timing controller according to claim 1, further comprising:

a housing member for receiving the second gear element, wherein:

the housing member includes a first housing and a second housing facing in a rotational shaft direction with each other and jointed by a joint member;

any one of the first housing and the second housing includes the first gear element;

one of the first housing and the second housing includes a projection projecting in the rotational shaft direction toward the other and provided in the circumferential direction; and the other of the first housing and the second housing engages with an inner peripheral surface or an outer peripheral surface of the projection.

29. A valve timing controller according to claim 28, wherein:

the other of the first housing and the second housing is press-fitted into the inner peripheral surface or the outer peripheral surface of the projection.

30. A valve timing controller for an internal combustion engine which adjusts valve timing of at least one of an intake valve and an exhaust valve opened/closed by a camshaft on the basis of torque transmission from a crankshaft to the camshaft, comprising:

a first gear element rotating in association with a first shaft which corresponds to one of the crankshaft and the camshaft;

a planetary carrier including an outer peripheral surface eccentric to the first gear element;

a second gear element including a central bore rotatably engaging to the outer peripheral surface and forming a gear mechanism in an internal gear engagement with the first gear element, the second gear element performing a planetary motion while engaging with the first gear element by a relative rotation of the planetary carrier to the first gear element;

a conversion portion for converting the planetary motion of the second gear element into a rotational motion of a second shaft, which correspond to the other of the crankshaft and the camshaft, to change a relative rotational phase between the crankshaft and the camshaft; and a plurality of pressing elements provided at different positions in the outer peripheral surface of the planetary carrier, spaced apart in a circumferential direction of the outer peripheral surface and disposed radially between the planetary carrier and the central bore, on eccentric side of the outer peripheral surface with respect to an orthogonal line that is orthogonal to an eccentric direction line of the outer peripheral surface and passes through an eccentric central line of the outer peripheral surface for pressing an inner peripheral surface of the central bore by elastic forces thereof, wherein an action line of the elastic force of at least one of the plurality of the pressing elements is inclined in the circumferential direction of the outer peripheral surface with respect to the eccentric direction line of the outer peripheral surface.

31. A valve timing controller according to claim 30, wherein:

the conversion portion includes a third gear element which forms a gear mechanism in an internal gear engagement with the second gear element at a position axially different from the engagement position between the first gear element and the second gear element for outputting the planetary motion of the second gear element to the second shaft.

32. A valve timing controller according to claim 30, wherein:

the pressing elements are located at both sides in the circumferential direction of the outer peripheral surface with respect to the eccentric direction line.

33. A valve timing controller according to claim 32, wherein:

the first gear element includes a drive-side rotational element rotating in association with the crankshaft and a driven-side rotational element rotating in a retard direction and in an advance direction relative to the drive-side rotational element, further comprising:

a stopper for contacting the driven-side rotational element with the drive-side rotational element in a retard side and an advance side to restrict a relative rotation of the driven-side rotational element, wherein:

the action line passes through a position deviating from a rotational center of the first gear element;

the elastic force of the pressing element located in a retard side to the eccentric direction line applies a rotational torque to the planetary carrier in an advance direction; and the elastic force of the pressing element located in an advance side to the eccentric direction line applies rotational torque to the planetary carrier in a retard direction.

34. A valve timing controller according to claim 33, wherein:

the action line passes substantially through an eccentric center of the outer peripheral surface.

35. A valve timing controller according to claim 34, wherein:

the pressing element is located within a range of 45° to 90° with respect to the eccentric direction line in the retard direction and in the advance direction of the planetary carrier relative to the drive-side rotational element.

* * * * *